US005655896A

United States Patent [19]

Konieczynski

[11] Patent Number: 5,655,896

[45] Date of Patent: Aug. 12, 1997

[54] APPARATUS FOR DISPENSING CONDUCTIVE COATING MATERIALS HAVING MULTIPLE FLOW PATHS

[75] Inventor: Ronald D. Konieczynski, North Royalton, Ohio

[73] Assignee: Nordson Corporation, Westlake, Ohio

[21] Appl. No.: 546,725

[22] Filed: Oct. 23, 1995

Related U.S. Application Data

[63] Continuation-in-part of Ser. No. 186,449, Jan. 25, 1994, abandoned.

[51] Int. Cl.[6] ..... F04B 23/04

[52] U.S. Cl. ..... 417/426; 417/53; 417/254; 417/346; 239/691; 239/708

[58] Field of Search ..... 417/53, 254, 344, 417/346, 926; 239/690, 691, 708; 137/566, 568

[56] References Cited

U.S. PATENT DOCUMENTS

| | | | |
|---|---|---|---|
| 277,305 | 5/1883 | Maltby . | |
| 482,776 | 9/1892 | Avery . | |
| 648,153 | 4/1900 | Serve . | |
| 1,549,332 | 8/1925 | Roberts . | |
| 2,660,456 | 11/1953 | Meddock | 285/317 |
| 2,811,950 | 11/1957 | Entz . | |
| 2,828,610 | 7/1958 | Bruehl . | |
| 2,898,130 | 8/1959 | Hansen | 285/317 |
| 3,063,423 | 11/1962 | Riordan . | |
| 3,104,619 | 9/1963 | Swartkout . | |
| 3,315,899 | 4/1967 | Quarve . | |
| 3,747,850 | 7/1973 | Hastings et al. . | |
| 3,818,807 | 6/1974 | Semple . | |
| 3,895,748 | 7/1975 | Klingenberg . | |
| 3,929,286 | 12/1975 | Hastings et al. . | |
| 3,971,337 | 7/1976 | Hastings et al. . | |
| 3,981,622 | 9/1976 | Hall et al. | 417/346 |
| 3,999,691 | 12/1976 | Doom . | |
| 4,004,717 | 1/1977 | Wanke . | |
| 4,017,029 | 4/1977 | Walberg . | |
| 4,020,866 | 5/1977 | Wiggins . | |
| 4,021,156 | 5/1977 | Fuchs, Jr. et al. | 417/346 |
| 4,053,012 | 10/1977 | Farmer . | |
| 4,085,892 | 4/1978 | Dalton . | |
| 4,124,163 | 11/1978 | Siegmann . | |
| 4,138,931 | 2/1979 | Hermann . | |
| 4,142,707 | 3/1979 | Bjorklund . | |
| 4,275,834 | 6/1981 | Spanjersberg et al. . | |
| 4,313,475 | 2/1982 | Wiggins . | |
| 4,489,893 | 12/1984 | Smead . | |
| 4,544,570 | 10/1985 | Plunkett et al. . | |
| 4,576,359 | 3/1986 | Tiker | 285/317 |
| 4,629,119 | 12/1986 | Plunkett et al. . | |
| 4,660,598 | 4/1987 | Butterfield et al. . | |
| 4,844,706 | 7/1989 | Katsuyama et al. | 417/339 |
| 4,878,622 | 11/1989 | Jamison et al. | 239/690.1 |
| 4,921,169 | 5/1990 | Tilly | 239/690 |
| 4,962,724 | 10/1990 | Prus et al. | 239/708 |
| 5,014,645 | 5/1991 | Cann | 239/708 |
| 5,078,168 | 1/1992 | Konieczynski | 239/691 |
| 5,152,466 | 10/1992 | Matushita | 239/690 |
| 5,197,676 | 3/1993 | Koniecyznski | 239/690 |
| 5,326,031 | 7/1994 | Konieczynski | 239/3 |

FOREIGN PATENT DOCUMENTS

| | | | |
|---|---|---|---|
| 2853347 | 11/1978 | Germany . | |
| 8705832 | 10/1987 | WIPO | 239/690 |

*Primary Examiner*—Charles G. Freay
*Attorney, Agent, or Firm*—Holland & Knight LLP

[57] ABSTRACT

An apparatus is provided for transferring electrically conductive coating materials, such as water-based paint, from a source to at least one coating dispenser such as a spray gun for discharge onto a substrate. In alternative embodiments, the coating material is supplied to the dispenser(s) from parallel flow paths which are comparatively simple and inexpensive in construction, and which are capable of delivering high pressure, high volume flows of coating material while substantially eliminating pressure fluctuations in the coating material supply when switching from one flow path to another.

22 Claims, 14 Drawing Sheets

APPARATUS FOR DISPENSING CONDUCTIVE COATING MATERIALS HAVING MULTIPLE FLOW PATHS

This application is a Continuation-In-Part of U.S. patent application Ser. No. 08/186,449 to Konieczynski, filed Jan. 25, 1994, entitled APPARATUS FOR DISPENSING CONDUCTIVE COATING MATERIALS HAVING SERIES AND PARALLEL FLOW PATHS, now abandoned which is owned by the assignee of this invention.

FIELD OF THE INVENTION

This invention relates to electrostatic spray coating and, more particularly, to a method and apparatus for dispensing electrically conductive coating materials wherein the source of conductive coating material is electrostatically isolated from a high voltage electrostatic power supply, and wherein the coating material is supplied to coating dispensers at comparatively high pressure without creating pressure fluctuations.

BACKGROUND OF THE INVENTION

The application of coating materials using electrostatic spraying techniques has been practiced in industry for many years. In these applications, the coating material is discharged in atomized form and an electrostatic charge is imparted to the atomized particles which are then directed toward a substrate maintained at a different potential to establish an electrostatic attraction for the charged atomized particles. As described in detail in U.S. Pat. Nos. 5,078,168 and 5,221,194, both owned by the assignee of this invention, the recent trend has been to shift away from the use of solvent-based coating materials, e.g. varnishes, lacquers, enamels, and the like, in favor of water-based coatings which reduce problems of explosiveness and toxicity which had plagued solvent-based coatings for many years. Unfortunately, this switch from electrostatically spraying solvent-based coatings to those of the water-based type has sharply increased the risk of electrical shock among system operators.

The problem of electrical shock from water-based coatings is addressed in U.S. Pat. Nos. 5,078,168 and 5,221,194 wherein a "voltage-block" system is provided for transferring electrically conductive coating materials without the formation of a completed electrical path between the source of coating material and the high voltage electrostatic power supply. The system in U.S. Pat. No. 5,078,168 comprises first and second shuttle devices which are serially connected to two large reservoir piston pumps. The first shuttle is movable between a transfer position and a neutral position relative to a filling station which is connected to a source of electrically conductive coating material. At the filling station, the first shuttle is operative to transfer coating material from the source into the reservoir of the first pump. In the neutral position, the first shuttle is electrically isolated, i.e. physically spaced, from the filling station. The second shuttle device is movable between a transfer position wherein it interconnects the first piston pump with the second piston pump, and a neutral position wherein the two pumps are electrically isolated from one another and the second piston pump supplies Coating material to the dispensers. Movement of the shuttles is controlled to maintain one of the shuttles in a neutral position at all times during a coating operation so that there is never a completed electrical path between the source of electrically conductive coating material and the electrostatically charged coating material at the dispenser(s).

One problem with apparatus of the type disclosed in U.S. Pat. No. 5,078,168 involves the pressure available to discharge the coating material from the reservoir of the second piston pump. Each of the first and second reservoir pumps includes a piston which is movable in one direction in response to the application of air pressure thereagainst to discharge coating material from the reservoir, and is movable in the opposite direction as new coating material is added to the reservoir. In order to permit filling of the reservoir of the second pump with coating material supplied from the first pump, the air pressure applied to the piston in the second pump must be reduced compared to that of the first pump otherwise the piston within the second pump would not move and allow the reservoir therein to be filled. Because of this reduced pressure level within the second pump, the coating material is discharged therefrom at a relatively low pressure level. As a result, comparatively few coating dispensers can be supplied with coating material from the second pump, and the spray pattern emitted from such dispensers is not always stable.

Another problem with voltage-block systems of the type disclosed in U.S. Pat. No. 5,078,168, is a relatively wide pressure fluctuation in the coating material discharged from the second pump to the coating dispenser(s). When the reservoir of the second pump is filled and coating material is discharged by its piston moving in a downward direction toward the base of the reservoir, the fluid pressure output from the second pump is less than the air pressure at which the piston is forced downwardly because the seal friction with which the piston seals against the side walls of the pump reservoir opposes downward motion of the piston. This produces a comparatively low fluid discharge pressure, significantly lower than the air pressure, with the attendant disadvantages noted above. On the other hand, a higher fluid discharge pressure, e.g. higher than the air pressure, is output from the second pump when it is filled with coating material from the first pump. This is because the fluid pressure of the coating material introduced at the base of the second pump, on the bottom side of the piston, must overcome both the air pressure acting on the opposite or top side of the piston and the seal friction of the piston seals against the side wall of the piston reservoir. Since the air pressure in the system remains constant, the fluid pressure fluctuates depending on whether the piston within the second pump is moving upwardly or downwardly. Accordingly, a potentially large pressure fluctuation can occur at the discharge side of the second pump depending upon whether or not the second pump is undergoing a fill cycle or a discharge cycle when coating material is discharged therefrom to the coating dispenser(s). Such pressure fluctuation limits the number of dispensers which can be supplied by the second pump, and/or adversely affects the spray pattern obtained from such dispensers.

These problems of adequate pressure at the coating dispensers and pressure fluctuation from the second piston pump have been addressed in U.S. Pat. No. 5,326,031 to Konieczynski, entitled "Apparatus for Dispensing Conductive Coating Materials Including Color Changing Capability," which is owned by the assignee of this invention. In this system, electrically conductive coating material is transmitted from two "parallel" flow paths to one or more coating dispensers. Each flow path comprises a voltage-block construction including a transfer unit having a filling station connected to the source(s) of coating material, a discharge station spaced from the filing station and a shuttle movable between and releasably coupled to the filing station and to the discharge station. Upon movement of the shuttle to the filling station of the transfer unit within one of the two flow paths, the shuttle is effective to transfer coating material from the source into the reservoir of a piston pump associated with such flow path. When the reservoir of the piston pump is filled, the shuttle moves and is coupled to the discharge station wherein a connection is made allowing the coating material to be transferred from the pump reservoir, through the discharge station of the transfer unit, and, into a "sync" valve connected to the dispensers. This sync valve is common to both flow paths and is effective to switch the flow of coating material to the dispensers from one flow path to the other. The operation of the system is synchronized such that when the pump of one flow path is supplying coating material to the dispensers, the pump of the other flow path is receiving coating material from the source. A voltage block is continuously maintained between the source and charged dispensers, and the dispensers can be essentially continuously supplied with coating material from one or the other of the parallel flow paths.

The system of U.S. Pat. No. 5,326,031 described above has proven to be highly successful for large, multiple gun systems intended for high volume, large quantity coating operations. But in low volume, single gun systems used in comparatively small manufacturing facilities, the parallel flow system of U.S. Pat. No. 5,326,031 provides more capacity than is required and is too costly.

SUMMARY OF THE INVENTION

It is therefore among the objectives of this invention to provide a method and apparatus for supplying conductive coating material, such as water-based paint, which protects against the transmission of an electrostatic charge between a high voltage electrostatic power supply and one or more conductive coating supplies, which avoids pressure fluctuation of the coating material at the coating dispensers, which transmits coating material to the coating dispensers at high pressure, which is capable of supplying coating material at high volume flow rates, which is simple in operation and construction, and, which is economical to purchase and maintain.

These objectives are accomplished in an apparatus for transferring electrically conductive coating materials, such as water-based paint, from a source to at least one coating dispenser such as a spray gun for discharge onto a substrate. In alternative embodiments, the coating material is supplied to the dispenser(s) from parallel flow paths which are comparatively simple and inexpensive in construction, and which are capable of delivering high pressure, high volume flows of coating material while substantially eliminating pressure fluctuations in the coating material supply when switching from one flow path to another. In one presently preferred embodiment, an upstream portion of the apparatus comprises a transfer unit, a transfer pump and a spray unit which are serially interconnected between a source of coating material and a common supply line leading to the downstream portion of the apparatus which includes a pair of spray pumps connected by a shuttle valve to one or more spray guns. The transfer unit and spray unit are operative to provide a continuous "voltage block" between the source of coating material and the electrostatically charged coating dispenser at the spray gun(s). The spray pumps are arranged in parallel with one another in position between the common supply line and the shuttle valve connected to the spray gun(s), and operate independently of the upstream portion of the system so that the coating material is supplied to the spray gun(s) at comparatively high pressure with minimal pressure fluctuation.

The above-described embodiment of this invention is predicated upon the concept of providing a comparatively low-priced, yet highly functional and efficient coating supply device which incorporates aspects of both the "series" coating supply devices such as disclosed in U.S. Pat. No. 5,078,168, and the "parallel" system disclosed in U.S. Pat. No. 5,326,031 discussed above. The upstream portion of the system of this invention, wherein the transfer shuttle, transfer pump and the spray shuttle are interconnected in series, provides an effective voltage block between the source of coating material and the charged coating material at the spray gun(s) while employing a minimum amount of hardware whose operation is controlled by a relatively simple pneumatic-mechanical valving system.

It has been recognized that in some applications a higher flow rate and flow capacity is desirable in order to satisfy production demand. While the "parallel" system disclosed in U.S. Pat. No. 5,236,031 provides such high capacity flow, the hardware and control system for switching from one parallel flow path to the other is relatively complex and expensive. The previously described embodiment of this invention simplifies the construction of a parallel delivery system, compared to U.S. Pat. No. 5,236,031, but sacrifices to some extent the flow rate and capacity available for delivery to one or more coating dispensers.

This limitation is addressed in an alternative embodiment of this invention in which two parallel flow paths are provided, each including a large reservoir piston pump, but wherein the "sync" valve described above is eliminated, together with complicated control systems. In this embodiment, each flow path includes a voltage block connected to the reservoir of the piston pump, and a shift valve which controls the movement of the shuttle of the voltage block between the fill position and discharge position. The discharge outlets of the voltage blocks of each flow path are connected to a common discharge line connected to one or more coating dispensers which is capable of receiving coating material from either one of the parallel flow paths, or from both of such paths simultaneously. The shift valves of each flow path are controlled by a valving arrangement contained in the opposite flow path so that when the piston pump of one flow path is nearly empty, the shift valve of the other flow path is actuated to cause its associated piston pump to deliver coating material to the coating dispensers simultaneously with the flow of coating material from the nearly empty piston pump. As such, coating material is supplied at the same time from both parallel flow paths for a short period of time in order to effect a smooth changeover of the supply of coating material from one flow path to the other. In this manner, no pressure fluctuations are experienced in the supply of coating material to the spray guns and the sync valve employed in U.S. Pat. No. 5,326,031, together with its relatively complicated control arrangement, are eliminated. At the same time, the capacity and flow volume which can be obtained from this embodiment of the invention is substantial and commensurate with that provided by the system of U.S. Pat. No. 5,326,031.

In either embodiment of this invention, the problems with inadequate pressure and pressure fluctuation noted above in connection with the discussion of the "series" apparatus of U.S. Pat. No. 5,078,168 are substantially eliminated. For example, in the first embodiment described above, the coating material is transmitted through the common supply line to each of the parallel spray pumps which fill and empty sequentially, i.e. while one of the pumps is supplying coating material to one or more spray guns, the other pump is being filled with coating material from the common supply line.

Each spray pump discharges at full pressure to the coating dispenser, independently of the other spray pump and independently of the upstream pressure in the system. Further, the shuttle valve which interconnects the parallel, spray pumps to the coating dispensers ensures that switching of the flow of coating material from one spray pump to the other is obtained without a pressure drop or other fluctuation in pressure. The same advantages are provided with the alternative embodiment of this invention described above, wherein two parallel flow paths eliminate the inherent limitations of a single series supply.

The apparatus of this invention is also provided with an efficient and economical means for dumping coating material contained within the system when it is desired to spray a new coating material, and this dumping mode of operation also provides for rapid oscillation of the pistons within each of the parallel, spray pumps to assist in the cleaning operation. The dumping operation is performed by a series of pneumatically and/or mechanically operated valves as described in detail below.

DESCRIPTION OF THE DRAWINGS

The structure, operation and advantages of the presently preferred embodiments of this invention will become further apparent upon consideration of the following description, taken in conjunction with the accompanying drawings, wherein.

DETAILED DESCRIPTION OF THE INVENTION

Figure 1:
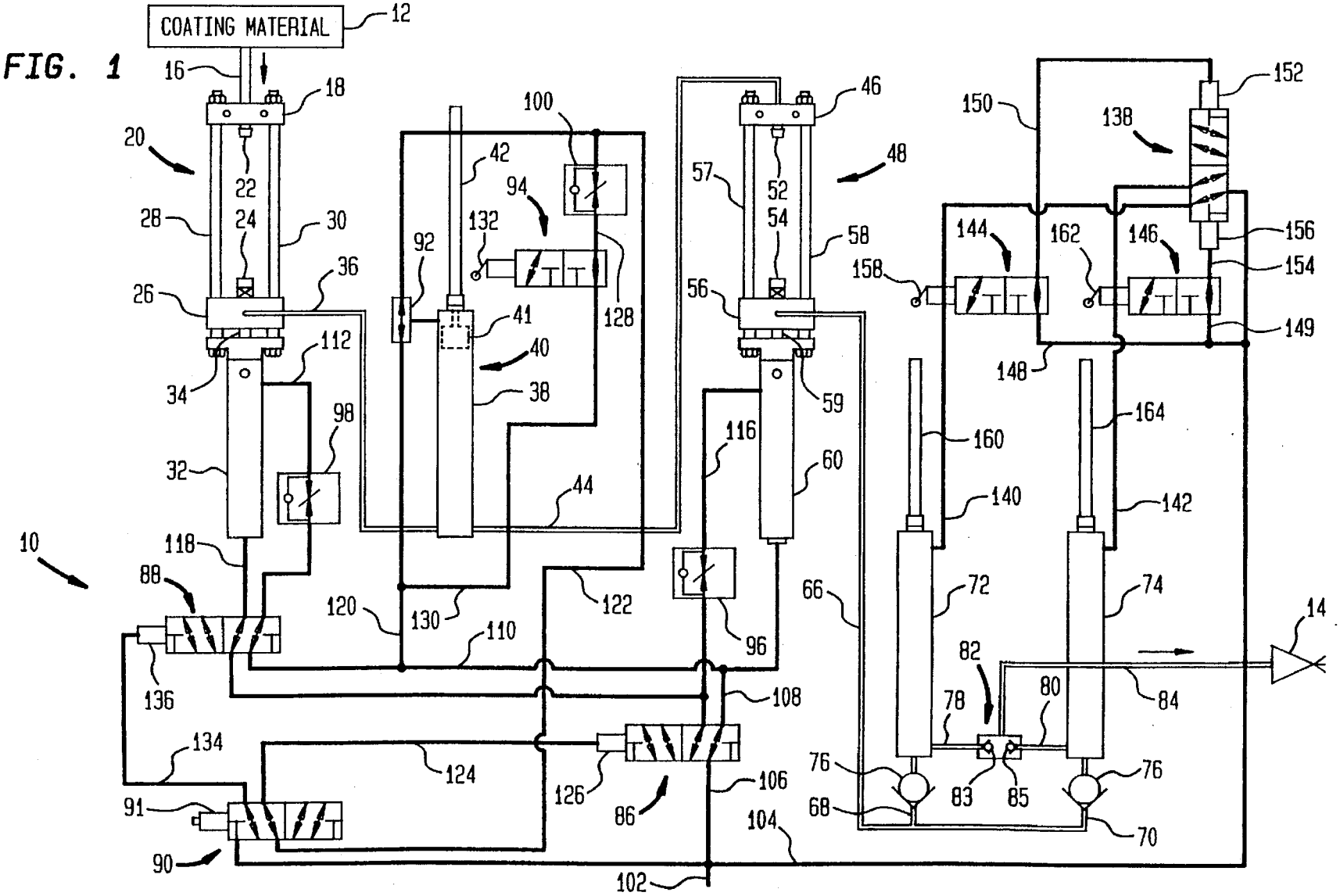
FIG. 1 is a schematic view of one embodiment of the overall system of this invention.

The discussion below is divided into two sections, one directed to an embodiment of this invention incorporating a combination of series and parallel flow paths and another describing alternative embodiments of improved multiple parallel flow path constructions. Within each section, the various elements of each system are separately described followed by a discussion of the operation of same.

APPARATUS WITH COMBINED SERIES AND PARALLEL FLOW PATHS

Referring initially to FIGS. 1–6, one embodiment of an apparatus 10 according to this invention comprises upstream and downstream elements for transmitting electrically conductive coating material from a source 12 to one or more coating dispensers 14, and a pneumatic/mechanical valving system for controlling the operation of such elements. For purposes of the present discussion, the term "upstream" refers to that portion of the system adjacent the source 12 of coating material, and the "downstream" portion of the system refers to those elements which feed the coating material to one or more coating dispensers such as spray gun 14. Preferably, the spray guns 14 are of the type sold by Nordson Corporation of Westlake, Ohio, the assignee of this invention, under Model No. AN-9, or rotary atomizers sold by Nordson Corporation under Model No. RA-12.

In order to facilitate understanding of the invention, the system elements involved in the transfer of coating material from the source 12 to the spray gun 14 are described initially, and then the valving system for controlling the operation of such elements is discussed. Finally, the combined operation of the coating material transfer elements and valving system is described with reference to FIGS. 2–6 wherein each aspect of the operation of system 10 is separately illustrated.

Paint Transfer Devices

With reference to the top left-hand portion of FIG. 1, the source 12 of coating material is connected by a supply line 16 to the filling station 18 of a first voltage block device 20. The filling station 18 mounts a male coupling element 22 which is mateable with a female coupling element 24 carried on a transfer shuttle 26. Preferably, the male and female coupling elements 22, 24 are of the type disclosed in U.S. Pat. No. 5,078,168, owned by the assignee of this invention, the disclosure of which is incorporated by reference in its entirety herein.

The transfer shuttle 26 is movable along a pair of guide rods 28, 30 by operation of a cylinder 32 having a piston 34. As described below, in response to the extension of piston 34 of cylinder 32, the transfer shuttle 26 is movable upwardly along guide rods 28, 30 to a transfer position wherein the male and female coupling elements 22, 24 engage one another. When the cylinder piston 34 is retracted, the transfer shuttle 26 is moved to a "neutral" position wherein the male and female coupling elements 22, 24 disengage and are physically spaced from one another.

The transfer shuttle 26 is connected by a line 36 to the reservoir 38 of a transfer pump 40. The transfer pump 40 includes an internal piston head 41 connected to an outwardly extending piston rod 42. The transfer pump 40 is pneumatically operated, as described in detail below, such that upon pressurization of that portion of the piston reservoir 38 above the piston head 41 the piston rod 42 and piston head 41 move downwardly to discharge coating material from the transfer pump 40.

The transfer pump 40 is connected by a line 44 to the discharge station 46 of a second voltage block device 48 which is similar in construction to the first voltage block device 20. The discharge station 46 of second voltage block device 48 mounts a male coupling element 52 which is mateable with a female coupling element 54 carried by a spray shuttle 56. The spray shuttle 56 is movable along a pair of guide rods 57, 58 in response to extension and retraction of a piston 59 associated with a pneumatic cylinder 60. In response to extension of cylinder piston 59, the spray shuttle 56 is movable to a transfer position wherein the male and female coupling elements 52, 54 engage one another. In response to retraction of the cylinder piston 59, the spray shuttle 56 is movable to a neutral position wherein the male and female coupling elements, 52, 54 disengage and are physically spaced from one another. The male and female coupling elements 52, 54 are identical to coupling elements 22, 24, and are disclosed in U.S. Pat. No. 5,078,168 noted above.

The spray shuttle 56 is connected to a common supply line 66, which, in turn, is connected by a pair of branch lines 68 and 70 to first and second spray pumps 72, 74, respectively. In the presently preferred embodiment, each of the branch lines 68 and 70 carries a check valve 76 of the type sold by Clippard Laboratory, Inc. of Cincinnati, Ohio, under Model No. MJCV-1. The first and second spray pumps 72, 74, in turn, are connected by feed lines 78 and 80, respectively, to a shuttle valve 82 of the type sold by Clippard Laboratory, Inc. under Model No. MJSV-1. As schematically illustrated in FIG. 1, the shuttle valve 82 includes a pair of check valves 83 and 85, connected to the feed lines 78, 80, respectively, to control the passage of coating material into the shuttle valve 82. The outlet of the shuttle valve 82 is connected by a discharge line 84 to the spray gun 14. As noted above, the detailed operation of the foregoing elements for the transfer of coating material from source 12 to spray gun 14 is described below with particular reference to FIGS. 2–6.

Pneumatic/Mechanical Control System

Considering first the upstream portion of the apparatus 10 shown in FIG. 1, the pneumatic/mechanical valving arrangement for controlling the operation of first voltage block device 20, transfer pump 40 and second voltage block device 48 includes an operating valve 86, a dump valve 88, a door valve 90, a quick exhaust or biased shuttle valve 92, a limit valve 94 and three flow control valves 96, 98 and 100. Preferably, the operating valve 86, is a four-way valve commercially available from Clippard Laboratory, Inc. under Model No. FV-4P, whereas the dump valve 88 and door valve 90 are Clippard Laboratory, Inc. five-way valves sold under Model No. FV-5P. The limit valve 94 is preferably a Clippard Laboratory, Inc. valve available under Model No. MJV0-3. The three flow control valves 96, 98, 100 are commercially available from Humphrey under Model No. HSC1/4-01B, which allow full flow in one direction and adjustable, metered flow in the opposite direction. For purposes of discussing the overall construction of the pneumatic/mechanical system of apparatus 10, all of the valves are shown in FIG. 1 in their inactivated positions with the operating air to the system turned "off" and the door valve 90 is depicted in position ready for the apparatus 10 to begin operation. The operation of such system in performing a coating and cleaning or flushing function is discussed below with particular reference to FIGS. 2–6.

Pressurized air is introduced into the valving system from a feed line 102 into a trunk line 104 which is connected by a line 106 to operating valve 86. The operating valve 86, in turn, is connected by a first line 108 to a first transfer line 110 having one end connected to the base of cylinder 60 associated with second voltage block device 48, and an opposite end connected to the dump valve 88. As depicted in FIG. 1, the dump valve 88 provides a flow path therethrough from transfer line 110 to a connector line 112 which leads to the top of cylinder 32 associated with first voltage block device 20. Preferably, the connector line carries flow control valve 98 therein. A second port of the operating valve 86 is connected by a second line 114 to a second transfer line 116 which carries the flow control valve 96. One end of second transfer line 116 is connected to the top portion of the cylinder 60 associated with second voltage block device 48, and the opposite end is connected to another port of the dump valve 88. A connector line 118 extends between the base of cylinder 32 associated with first voltage block device 20 and the dump valve 88 to permit the transfer of pressurized air to the cylinder 32 from the second transfer line 116.

With reference to the top center portion of FIG. 1, one side of the biased shuttle valve 92 is connected by a line 120 to the first transfer line 110. The opposite side of biased shuttle valve 92 is connected by a line 122 to one side of the door valve 90, which, in turn, is connected by a pilot line 124 to the pilot 126 of operating valve 86. One side of limit valve 94 is connected to line 122 by a branch line 128 which carries flow control valve 100, and the opposite side of limit valve 94 is connected by a line 130 to line 120. As schematically illustrated in FIG. 1, the limit valve 94 has a trip bar 132 operatively associated with the piston rod 42 of transfer pump 40 such that movement of the piston rod 42 to a retracted position actuates the limit valve 94 in a manner described below.

As noted at the bottom of FIG. 1, the air trunk line 104 is also connected to one side of the door valve 90, which, in the closed position, permits venting of air from dump valve 88 therethrough via the pilot 136. The dump valve 88 is therefore continuously exhausted in the position depicted in FIG. 1, except during a dump and clean operation described in detail below in connection with a discussion of the operation of apparatus 10.

One important aspect of this embodiment of the subject invention is that the operation of the parallel spray pumps 72 and 74 proceeds essentially independently of the operation of the upstream portion of the system consisting of first voltage block device 20, transfer pump 40 and second voltage block device 48. In particular, the pressure with which coating material is supplied to spray gun 14 by each of the first and second spray pumps 72, 74 is completely independent of the pressure of the coating material delivered into the common supply line 66 by second voltage block device 48. This is achieved by the parallel relationship of first and second spray pumps 72, 74, and by the fact that pressurized air from trunk line 104 is transmitted directly through pneumatic and mechanical valves associated with spray pumps 72, 74 which operate independently of all other valves within the system.

With reference to the right-hand portion of FIG. 1, the trunk line 104 is connected to one side of a four-way, shift valve 138 preferably of the type commercially available from Clippard Laboratory, Inc. under Model No. MJV-4D. In the position of shift valve 138 depicted in FIG. 1, the pressurized air from trunk line 104 passes therethrough into a connector line 140 which is connected to the top portion of the first spray pump 72. Another port of the shift valve 138 is connected by a second connector line 142 to the top portion of second spray pump 74. Limit valves 144 and 146 are associated with each of the first and second spray pumps 72, 74, respectively. Limit valve 144 is connected by a line 148 to the trunk line 104 and limit valve 146 is connected to line 148 by a branch line 149. Pressurized air from line 148 is transmitted through limit valve 144 into a line 150 connected to a pilot 152 of shift valve 138, while the limit valve 146 transmits pressurized air from branch line 149 therethrough into a pilot line 154 connected to a second pilot 156 of shift valve 138. In the presently preferred embodiment, the limit valve 144 includes a trip bar 158 which is operatively associated with the piston 160 of first spray pump 72, and, similarly, the limit valve 146 has a trip bar 162 operatively associated with the piston 164 of second spray pump 74.

OPERATION OF APPARATUS

With reference to FIGS. 2–6, the various operations of the apparatus 10 are illustrated. For ease of understanding, each of the FIGS. 2–6 has been simplified by eliminating some of the pneumatic lines and/or paint lines so that only those lines which are involved in a particular operation are shown. Reference should be made to FIG. 1 for a view of the complete schematic of the apparatus 10 of this embodiment of the subject invention.

Filling of Transfer Pump

Figure 2:
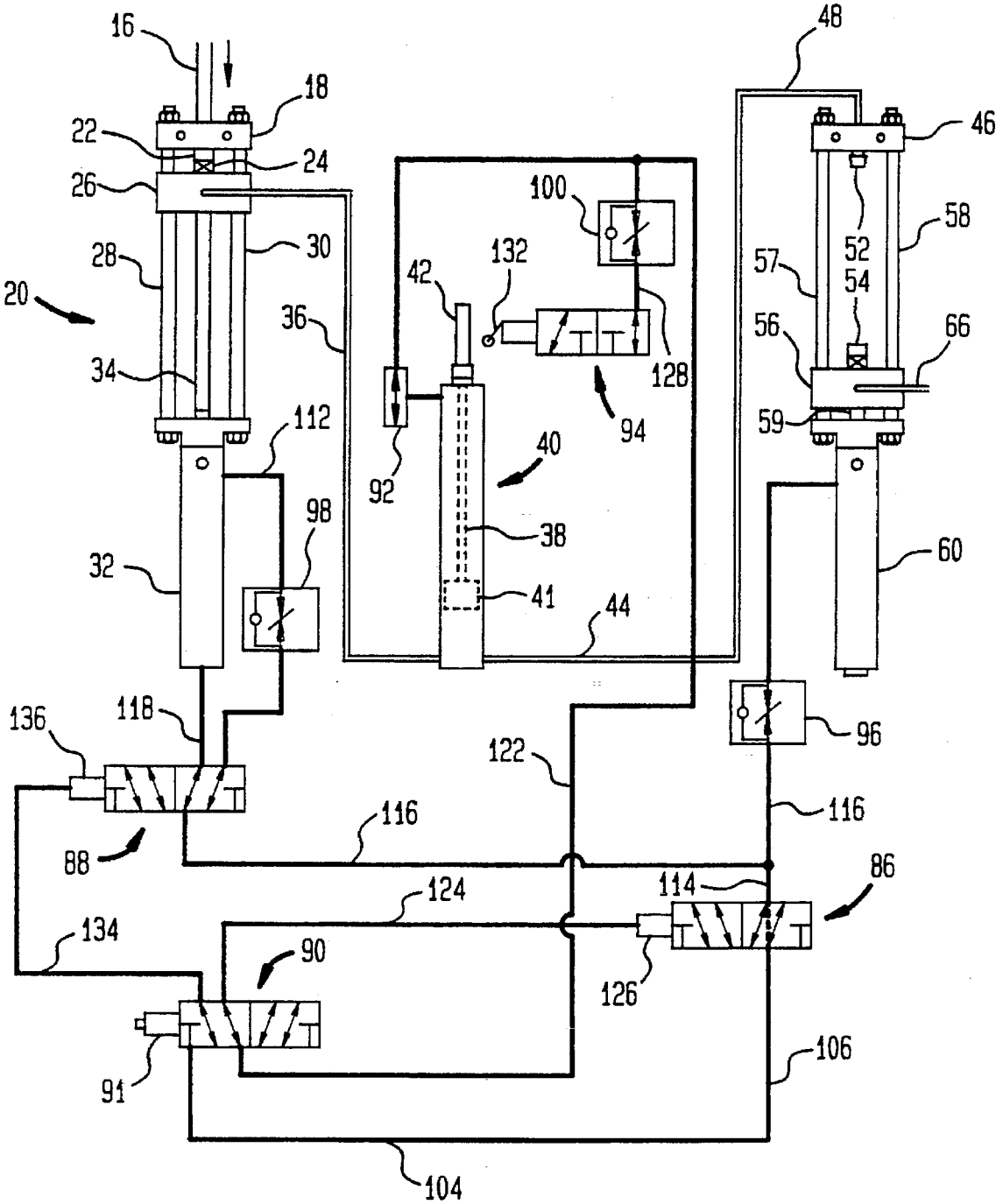
FIG. 2 is a partial schematic view of the upstream portion of the system of FIG. 1 with the elements positioned to fill the transfer pump.

Referring to FIGS. 1 and 2, the first voltage block device 20, transfer pump 40 and second voltage block device 48 are involved in the transfer of coating material from the source 12 into the transfer pump 40 while maintaining a voltage block between the source 12 and spray gun 14. It is assumed for purposes of discussion that the transfer pump 40 has been nearly emptied of coating material, and the operating valve 86 is initially in the position depicted in FIG. 1 wherein pressurized air is allowed to pass through operating valve 86 and line 108 into first transfer line 110, and then through line 120 to the biased shuttle valve 92. With pressurized air at the side of shuttle valve 92 connected to line 120, air is introduced at the top of transfer pump 40 thus forcing the piston head 41 downwardly within the pump reservoir 38 causing the coating material therein to discharge through line 44.

When the piston head 41 has reached a predetermined lowermost limit of travel within pump reservoir 38, the trip bar 132 of limit switch 94 operates to permit the flow of pressurized air from line 130, through the limit switch 94 and then through flow control valve 100 into the air line 122. The pressurized air is transmitted from air line 122 through door valve 90 into the pilot line 124 connected to the pilot 126 of operating valve 86. The flow of pressurized air to its pilot 126 causes the operating valve 86 to assume the position depicted in FIG. 2. In this position, pressurized air flows through the operating valve 86 into the second line 114 which feeds second transfer line 116. In turn, pressurized air is directed through the dump valve 88 into connector line 118 leading to the base of cylinder 32, and via line 116 to the top of cylinder 60 associated with second voltage block device 48. Pressurization of the base of cylinder 32 associated with first voltage block device 20 causes the transfer shuttle 26 to move to the transfer position at the filling station 18 wherein the male and female coupling elements 22, 24 engage one another. Coating material from the source 12 is then permitted to flow between the coupling elements 22, 24 and through transfer shuttle 26 into the reservoir 38 of transfer pump 40. At the same time, pressurization of the top of cylinder 60 associated with second voltage block device 48 causes the piston 59 to retract and move the spray shuttle 56 to a neutral position wherein the male and female coupling elements 52, 54 are disengaged and physically spaced from one another. As a result, a voltage block or air gap is created by the second voltage block device 48 between the source of coating material 12 and the common supply 66 leading to the spray gun 14.

As the transfer pump 40 is being filled with coating material from source 12 through first voltage block device 20, the piston head 41 moves vertically upwardly within the reservoir 38. In turn, the air which is present within the pump reservoir 38, above piston head 41, is forced outwardly from the transfer pump 40 into the biased shuttle valve 92. The biased shuttle valve 92 is effective to vent this air from the transfer pump 40 through line 122 and then through the door valve 90 into the pilot line 124. Accordingly, the limit valve 94 and biased shuttle valve 92 cooperate to pilot the operating valve 86 throughout the filling operation of transfer pump 40. As noted above, the limit valve 94 initially permits a flow of pressurized air to pass into line 122 which is then directed into the pilot line 124 through door valve 90. This initially pilots the operating valve 86 to cause the transfer shuttle 26 to move to the transfer position, and the spray shuttle 56 to move to a neutral position, as described above. After coating material begins to enter the transfer pump reservoir 38, and the piston head 41 moves upwardly therein, piloting of the operating valve 86 is maintained by venting the air within transfer pump 40 through biased shuttle valve 92, line 122 and door valve 90 into the pilot line 124. This gradual venting of air from transfer pump 40 therefore provides a continuous pilot on the operating valve 86 so that it maintains its piloted position depicted in FIG. 2. The operating valve 86 is held in the position shown in FIG. 2 until the air is completely exhausted from transfer pump 40.

Discharge of Coating Material from Transfer Pump

Figure 3:
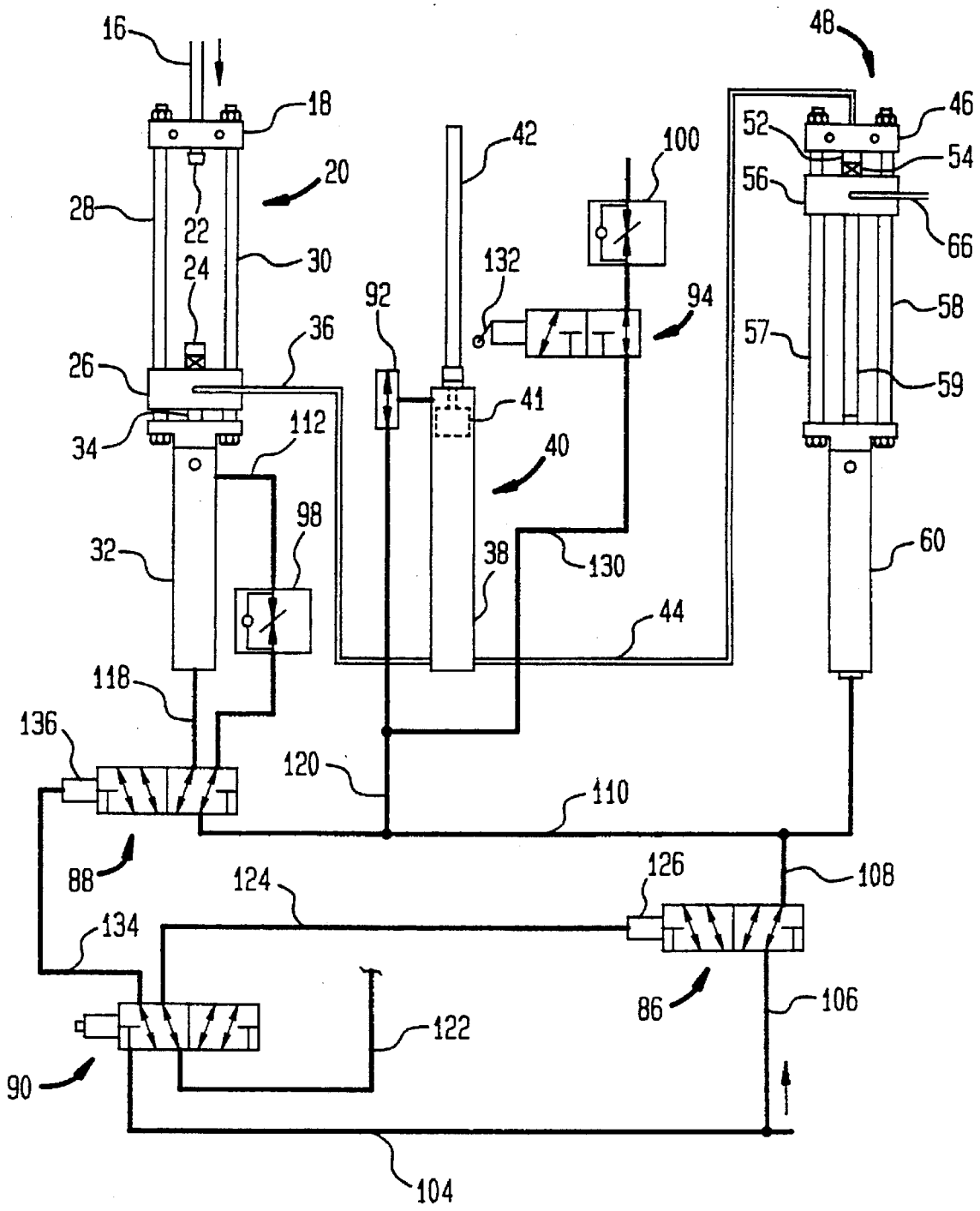
FIG. 3 is a view similar to FIG. 2 except with the system elements positioned to transmit coating material out of the transfer pump to the spray pumps.

With reference to FIG. 3, apparatus 10 is depicted in the position to transfer coating material from the transfer pump 40 through the second voltage block device 48 into common supply line 66. As noted above, pilot air is maintained on the operating valve 86 until such time as the air within transfer pump 40 is replaced with coating material. Once the supply of air within transfer pump 40 is exhausted, the operating valve 86 is no longer piloted and thus shifts to the position depicted in FIG. 3. In this position, pressurized air from line 106 passes through the operating valve 86 into line 108 connected to the first transfer line 110. The first transfer line 110, in turn, supplies air to the base of cylinder 60 associated with second voltage block device 48, and also into the port of dump valve 88 which is connected to line 112 leading to the top of cylinder 32 associated with first voltage block device 20. As a result, the spray shuttle 56 of second voltage block device 48 moves to the transfer station 46 so that the coupling elements 52, 54 engage one another. At the same time, the cylinder 32 of first voltage block device 20 is activated to retract its piston 34 and thus disconnect the male and female coupling elements 22, 24 so that a voltage block or air gap is created between the source of coating material 12 and the transfer pump 40.

The supply of pressurized air to first transfer line 110 also results in the flow of operating air through line 120 to the biased shuttle valve 92. The pressurized air passes through the biased shuttle valve 92 and enters the top of transfer pump 40, above its piston head 41, thus causing the piston 42 to move downwardly within the pump reservoir 38. In turn, coating material within the pump reservoir 38 is forced through its outlet into line 44 which connects to the discharge station 46. Because the spray shuttle 56 is in the discharge position with respect to discharge station 46, the flow of coating material from transfer pump 40 is allowed to enter the common supply line 66 for transmission to the first and second spray pumps 72, 74.

The transfer operation of coating material from the transfer pump 40 into the common supply line 66 continues until the quantity of coating material within pump reservoir 38 reaches a predetermined lowermost level. At this point, the limit switch 94 is tripped by operation of its trip bar 132 which resumes the filling operation of transfer pump 40 described above in connection with a discussion of FIG. 2.

Filling and Emptying of Spray Pumps

Figure 4:
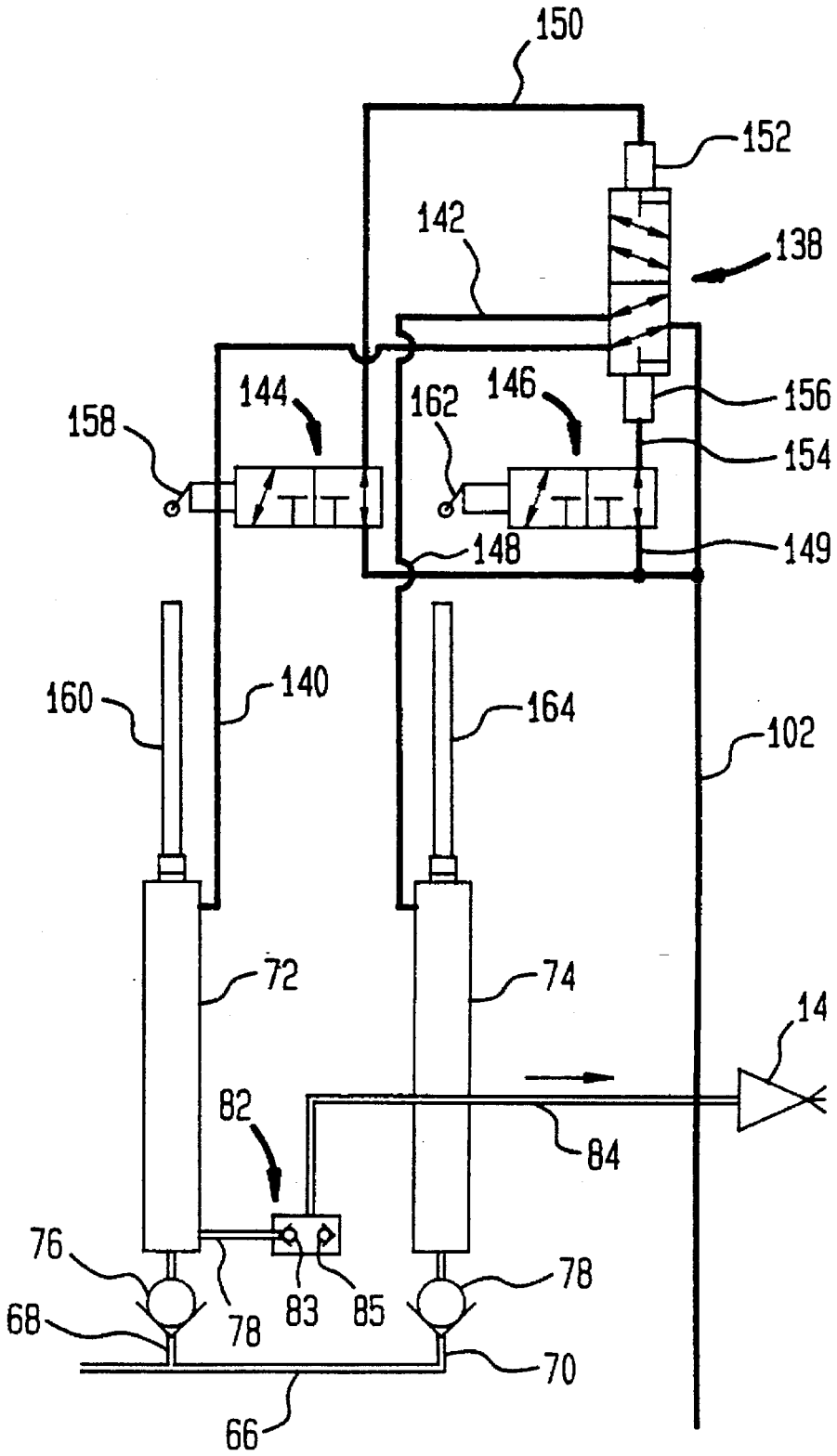
FIG. 4 is a partial schematic view of the downstream portion of the system depicted in FIG. 1 with the elements positioned to transmit coating material from the first spray pump to one or more coating dispensers.
Figure 5:
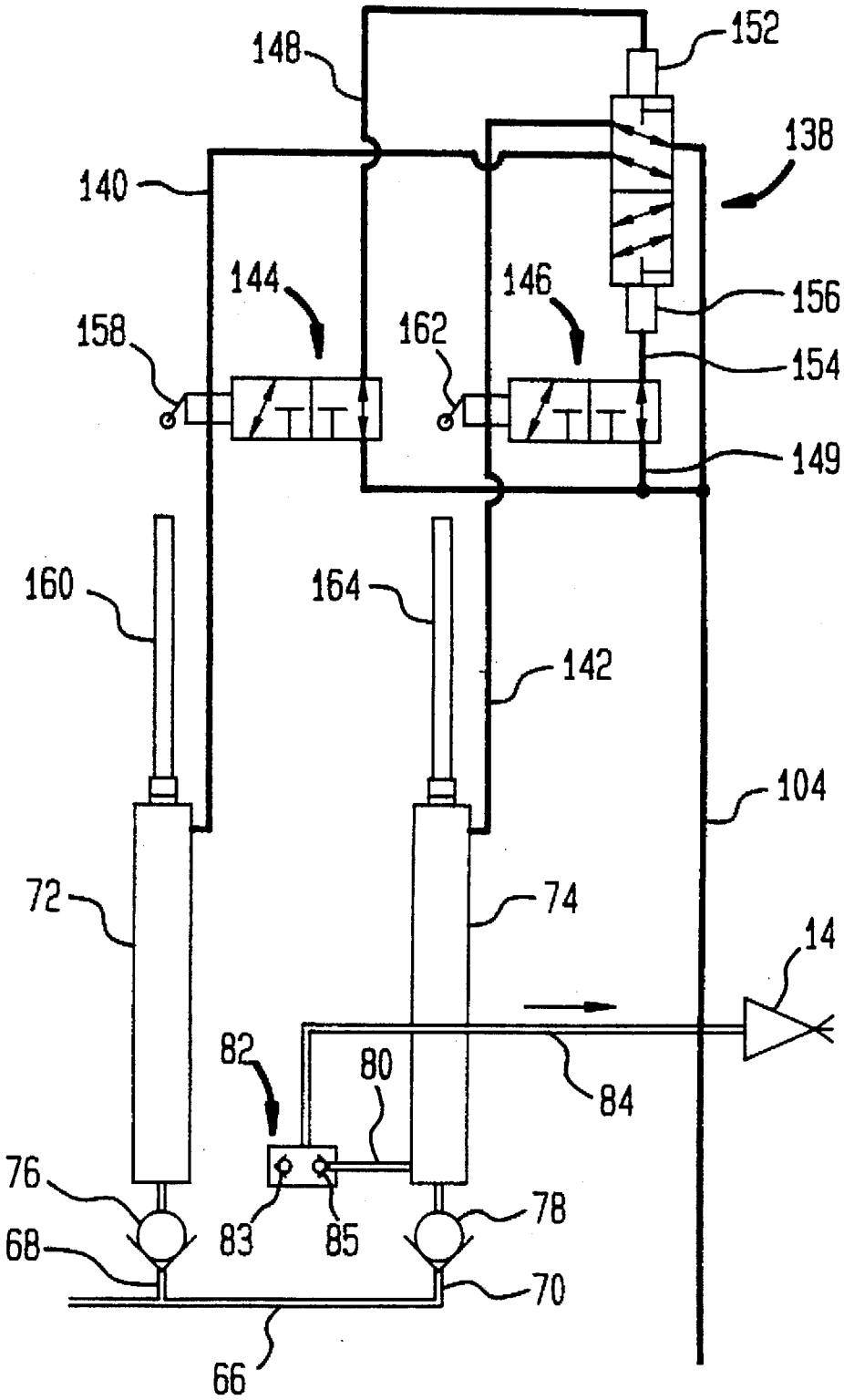
FIG. 5 is a view similar to FIG. 4 except with the system elements positioned to transfer coating material from the second spray pump to the coating dispensers.

With reference to FIGS. 4 and 5, the downstream portion of apparatus 10 is illustrated apart from the remainder of the system. For ease of description, it is assumed in FIG. 4 that the first spray pump 72 has been previously filled with coating material, and the second transfer pump 74 is empty and ready for filling. With the shift valve 138 in the position depicted in FIG. 4, a flow of pressurized air from trunk line 104 is permitted to pass therethrough and into line 140 leading to the top of first spray pump 72. This causes the piston 160 associated with first spray pump 72 to move downwardly thus forcing coating material out of the reservoir of pump 72, into line 78, and then through shuttle valve 82 into the discharge line 84 connected to spray gun 14.

With shift valve in the position shown in FIG. 4, air within the interior of second spray pump 74 is allowed to vent therefrom through line 142 and shift valve 138 so that the interior of second spray pump 74 is at essentially atmospheric pressure. Because the first spray pump 72 is pressurized, as explained above, the coating material within common line 66 takes the path of least resistance and enters the second spray pump 74 through branch line 70 and check valve 78 to fill the second spray pump 74 while the first spray pump 72 is emptying.

Once the piston 160 associated with first spray pump 72 has reached a predetermined, lowermost position within the reservoir of pump 72, the trip bar 158 of limit valve 144 is released which opens the normally closed limit valve 144 allowing air from line 148 to pass through limit valve 144 and enter line 150. The flow of air through line 150 closes pilot 152 and causes shift valve 138 to shift to the position depicted in FIG. 5. In this position of valve 138, pressurized air from trunk line 104 enters a port of shift valve 138 which permits the transfer of air therethrough to the line 142 connected to the top portion of second spray pump 74. At the same time, the port associated with shift valve 138 which is connected to line 140 from first spray pump 72 is vented to atmosphere. Accordingly, the second spray pump 74 begins to pressurize in preparation to discharge the coating material therein to shuttle valve 82 while the first spray pump 72 begins to exhaust air in preparation to receive coating material from common supply line 66.

One important aspect of this embodiment of the subject invention is to avoid pressure fluctuation in the supply of coating material to spray gun 14. This is achieved in this invention by the changeover of the supply of coating material to spray gun 14 between the first and second spray pump 72, 74. As noted above, once the limit valve 144 is tripped so that the shift valve 138 is piloted at 152, the pressurized air within the nearly empty first spray pump 72 is allowed to vent through line 140 while pressurized air is supplied to the nearly full second spray pump 74 through line 142. Because the first spray pump 72 is still fully pressurized, and the second spray pump 74 only is beginning to receive pressurized air, coating material is still supplied from the first spray pump 72 through shuttle valve 82 into the discharge line 84 to gun 14. This flow of coating material from first spray pump 72 continues until the air pressure at the top of second spray pump 74 is at least equal to the pressure from first spray pump 72 on the other side of shuttle valve 82. Only when such pressure equalization takes place will the coating material from second spray pump 74 have sufficient pressure to unseat the one-way valve 85 within shuttle valve 82 connected to line 80 and then pass into the discharge line 84. Before such pressure equalization takes place, the one-way valve 83 within shuttle 82 which is connected to line 78 remains unseated by the pressure exerted from first spray pump 72, and the flow of coating material into the discharge line 84 comes from the first spray pump 72.

It is contemplated that the pressurized air within first spray pump 72 will vent through line 140, and the top of second spray pump 74 will be pressurized by air from line 142, in a relatively short period of time so that the shift from spray pump 72 to spray pump 74 can take place rapidly. As a result, there is very little pressure fluctuation of the coating material which exits shuttle valve 82 into the discharge line 84 since first spray pump 72 is able to maintain pressure during the period of time necessary to fully pressurize second spray pump 74 and allow it to take over the supply of coating material to the spray gun 14.

Additionally, it should be noted that both the first and second spray pump 72, 74 are supplied with pressurized air via trunk line 104 directly through the shift valve 138 and the respective air supply lines 140, 142. Little or no pressure drop occurs over this flow path, and therefore the coating material transmitted to the spray gun 14 through discharge line 84 is at a consistent high pressure.

The above-described process is simply reversed in switching from second spray pump 74 back to first spray pump 72. Because the first spray pump 72 is vented to atmosphere, it receives coating material from common supply line 66 and branch line 68 past the check valve 76. When the second spray pump 74 is nearly emptied of coating material, its piston 164 releases trip bar 162 of limit valve 146 allowing air from line 149 to pass through the now opened limit valve 146 into the line 154 to pilot 156. This closes the pilot 156 causing limit valve 146 to shift to the position depicted in FIG. 4 where pressurized air is supplied to first spray pump 72 and second spray pump 74 is allowed to vent.

Dump and Clean Operation

Figure 6:
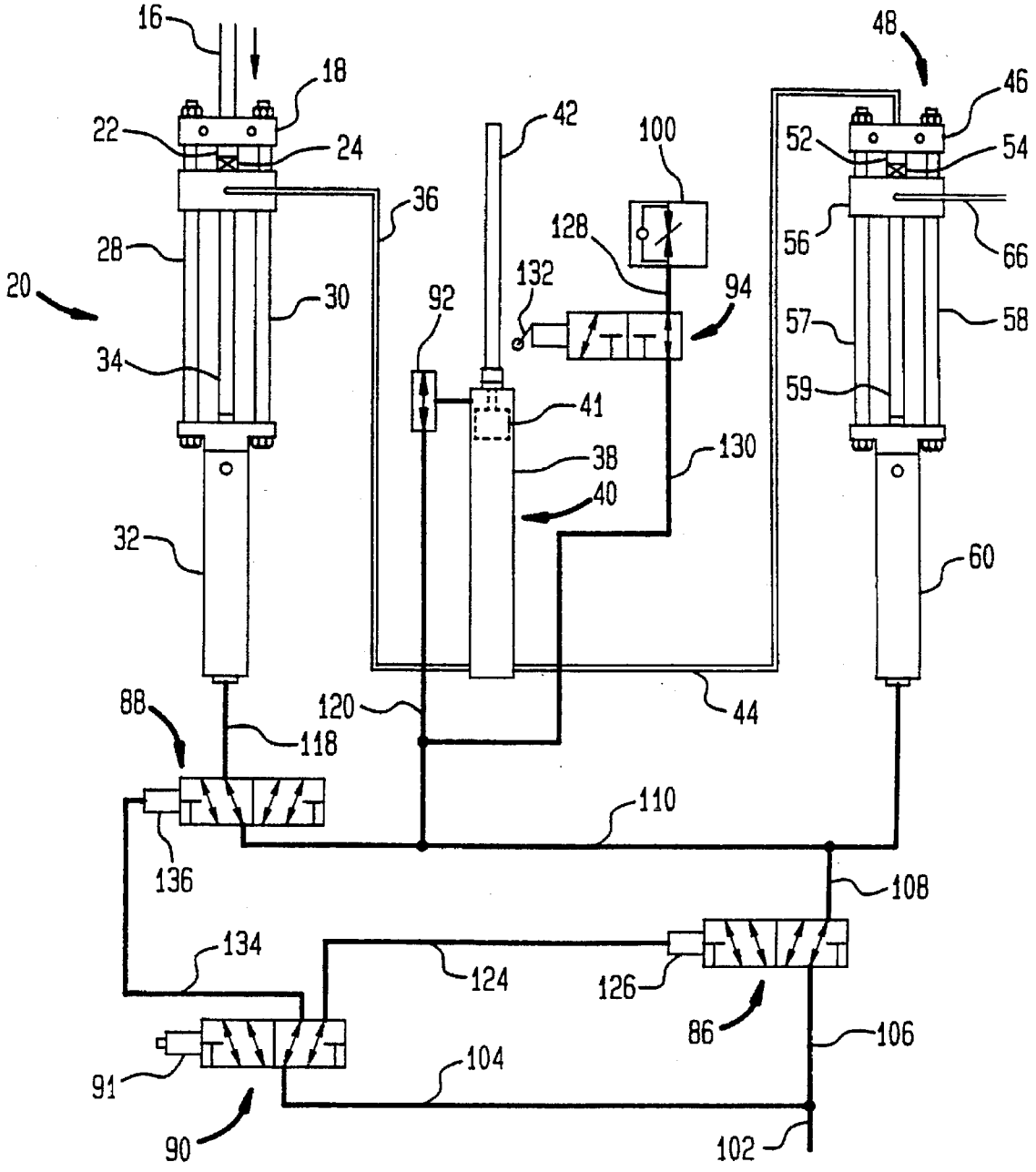
FIG. 6 is a partial schematic view of the upstream portion of the system illustrated in FIG. 1 with the elements positioned in a dump and system cleaning mode.

With reference to FIGS. 1 and 6, when it is desired to remove the remaining coating material from the apparatus 10 at the end of a production run or to change colors, the apparatus 10 of this embodiment of the subject invention provides an easy and efficient means of accomplishing both the dumping and cleaning operations. Initially, the flow of coating material from source 12 is shut off, and the door of the cabinet (not shown) which houses the apparatus 10 is then opened to mechanically deactivate the pilot 91 of door valve 90. When deactivated, the door valve 90 shifts position from that shown in FIG. 1 to that shown in FIG. 6. In this shifted position, pressurized air from trunk line 104 passes through door valve 90 into the pilot line 134 connected to the pilot 136 of dump valve 88. This causes the dump valve 88 to move to the position depicted in FIG. 6 wherein line 110 is connected through dump valve 88 to the line 118 leading to the base of cylinder 32. With the operating valve 86 in the unpiloted position depicted in FIG. 6, pressurized air is transmitted through first transfer line 110 to the bottom portion of the cylinder 32 associated with first voltage block device 20, and to the bottom of the cylinder 60 associated with second voltage block device 48. In turn, both the transfer shuttle 26 and spray shuttle 56 are moved to their coupled positions, i.e. the transfer shuttle 26 moves to the transfer position at the filling station 18 of first voltage block device 20, and the spray shuttle 56 moves to a coupled, discharge position at the discharge station 46 of second voltage block device 48.

With the transfer shuttle 26 and spray shuttle 48 in the above-mentioned positions, the entire system is grounded out thus preventing any electrical hazard in the area of the spray gun 14. At the same time, pressurized air flows through first transfer line 110 into the line 120 leading to the biased shuttle valve 92 associated with transfer pump 40. As discussed above, pressurized air from line 120 flows through the biased shuttle valve 92 thus forcing the piston head 41 of transfer pump 40 downwardly to discharge all of the coating material from its reservoir 38. Because the spray shuttle 56 is in a discharge position at the discharge station 46, the coating material emitted from transfer pump 40 flows through line 44 into the spray shuttle 56 and then to the common supply line 66 for transmission to the first and second spray pump 72, 74.

Meanwhile, the spray pumps 72, 74 continue to operate as if coating material was being supplied to them from common supply line 66 under normal operating conditions. That is, the first and second spray pumps 72, 74 behave the same way when coating material is being dumped from transfer pump 40 as they do when it is supplied during normal system operation. For example, assume the first spray pump 72 is empty of coating material at the time of a dump operation, while second spray pump 74 has at least some coating material remaining. Under these circumstances, the first spray pump 72 would receive coating material dumped from the transfer pump 40 while the second spray pump 74 continues to discharge the coating material remaining therein out the spray gun 14. See FIG. 5. Once the coating material within second spray pump 74 is completely dumped, no new coating material is available from common supply line 66 to fill such pump 74 and therefore its piston 162 remains in a fully retracted position. The first spray pump 72 dumps the coating material through the shuttle valve 82 and out line 84 to spray gun 14 until such time as all the coating material it contains has been depleted. At this point, the pistons 160 and 164 of first and second spray pumps 72, 74 are in a completely lowered or retracted position with the first spray pump 72 pressurized because it was last to empty while the second spray pump 74 is at atmospheric pressure. See FIG. 4.

With the system completely dumped of coating material, a cleaning fluid such as water, solvent or the like can then be added to remove any coating material which remains within the lines and various system elements. The cleaning fluid is introduced into the system at the filling station 18 of first voltage block device 20 and flows through the first voltage block device 20, line 36, transfer pump 40, line 44, second voltage block device 48 and common supply line 66 to the first and second spray pump 72, 74. All of the aforementioned lines and system elements are serially interconnected, and are cleaned of any remaining coating material by the passage of the flushing or cleaning liquid therethrough.

Once the cleaning fluid reaches the first and second spray pump 72, 74 an "agitation" cycle takes place as follows. Assuming the first spray pump 72 is pressurized as noted in the example given above, the cleaning fluid enters the second spray pump 74 through line 70 and check valve 78. With both pump pistons 160 and 164 in the fully retracted position, the limit valves 144 and 146 associated with first and second spray pump 72, 74, respectively, are positioned to each send pilot air to the shift valve 138. That is, pressurized air passes through limit valve 144 and into line 150 to the pilot 152 of shift valve 138, while pressurized air also passes through the limit valve 146 into line 154 to the pilot 156 of shift valve 138. Shortly after the piston 164 of second spray pump 74 begins to move upwardly in response to the presence of cleaning fluid within the reservoir of spray pump 74, the trip bar 162 of limit valve 146 is actuated which closes the flow of pilot air to the pilot 156 of shift valve 138. Because pilot air continues to flow through line 150 to the pilot 152 of shift valve 138, the shift valve 138 moves to the position depicted in FIG. 5. This causes pressurized air to flow through shift valve 138 into line 142 connected to the top of second spray pump 74, and allows air within the interior of first spray pump 72 to be vented via line 140 through shift valve 138. The small quantity of cleaning fluid which was allowed to collect in the bottom of second spray pump 74 is then discharged therefrom, while cleaning fluid is allowed to enter the first spray pump 72 which is now at atmospheric pressure. As soon as a small quantity of cleaning fluid collects within the bottom portion of the first spray pump 72, its limit valve 144 is activated by upward movement of piston 160, which, in turn, moves the shift valve 138 back to the position depicted in FIG. 4. As discussed above, this pressurizes the first spray pump 72 to discharge cleaning fluid therefrom, and allows the second spray pump 74 to return to atmospheric pressure so that it can receive additional cleaning fluid.

Accordingly, with the introduction of a cleaning fluid into the apparatus 10 while the door valve 90 is in the open position depicted in FIG. 6, the first and second spray pump 72 and 74 alternately fill to a small extent, and then empty, in an agitating fashion, i.e. wherein their respective pistons 160 and 164 rapidly move upwardly and downwardly as cleaning fluid enters and leaves spray pumps 72, 74. This speeds up the cleaning operation and effectively cleans the spray pumps 72, 74, the shuttle valve 82, discharge line 84 and spray gun 14. Once the door of the cabinet associated with apparatus 10 (not shown) is closed allowing door valve 90 to return to the position depicted in FIG. 1, the flow of cleaning fluid is discontinued and the apparatus 10 is ready to accept new coating material in preparation to resume another coating operation.

APPARATUS WITH PARALLEL FLOW PATHS

With reference now to FIGS. 7–10, an alternative embodiment of an apparatus 200 in accordance with this invention is depicted. The apparatus 200 herein differs from the apparatus 10 described above in that the upstream, series portion of the apparatus 10 is eliminated in apparatus 200 so that the system is closer in construction to that described in U.S. Pat. No. 5,326,031, the disclosure of which is incorporated by reference in its entirety herein. Importantly, the apparatus 200 of this invention is simplified and more efficient compared to the system disclosed in U.S. Pat. No. 5,326,031.

Consistent with the discussion of apparatus 10 above, the apparatus 200 of this embodiment is described with reference first to a discussion of the transfer of coating material from a supply to one or more coating dispensers, and then the pneumatic/mechanical control system is discussed separately. Finally, the combined operation of the paint transfer system is described including a discussion of a color change operation and cleaning/agitation operation.

Paint Transfer Devices

Figure 7:
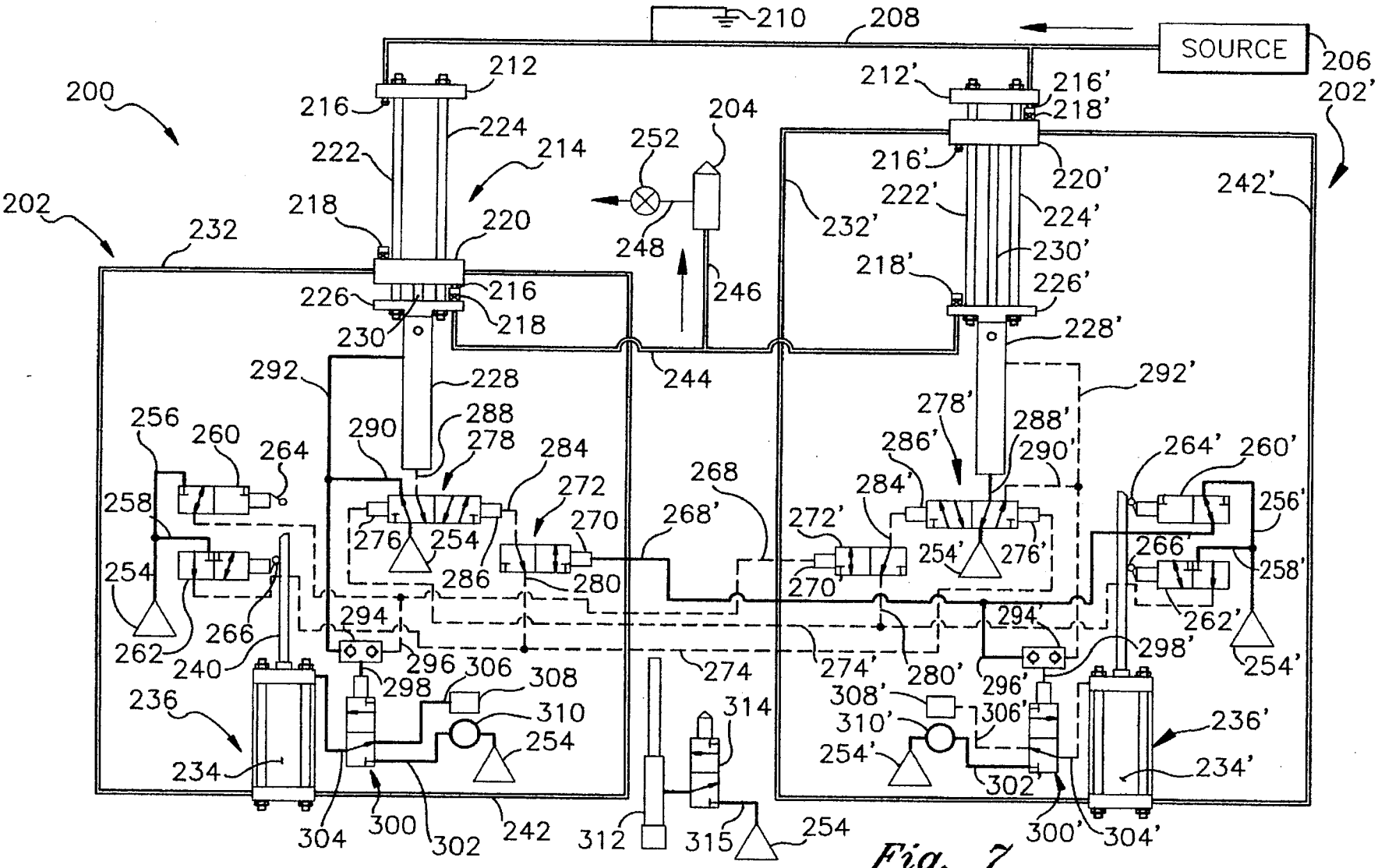
FIG. 7 is an overall schematic view of an alternative embodiment of this invention.

With reference initially to FIG. 7, the apparatus 200 is illustrated as incorporating a first paint supply unit 202 and a second paint supply unit 202' which are arranged in parallel with respect to at least one coating dispenser 204 depicted schematically in the Figs. For purposes of the present discussion, only the construction of the paint supply unit 202 is described below, it being understood that the second paint supply unit 202' is structurally and functionally identical. The same reference numbers used in the description of paint supply unit 202 are given to like structural elements of paint supply unit 202' with the addition of a "'" to such numbers.

In the presently preferred embodiment, a source 206 of coating material is connected by a supply line 208, grounded at 210, to the filling station 212 of a voltage block device 214. The filling station 212 mounts a male coupling element 216 which is mateable with a female coupling element 218 carried on a transfer shuttle 220 of the voltage block device 214. Preferably, the male and female coupling elements 216, 218 are of the type disclosed in U.S. Pat. No. 5,078,168, and are the same as employed in the apparatus 10 depicted in FIGS. 1–6 as elements 22, 24 and elements 52, 54.

The transfer shuttle 220 is movable along a pair of guide rods 222 and 224 which extend between the filling station 212 and a discharge station 226 of voltage block device 214. The bottom surface of shuttle 220 mounts a male coupling element 216 which is mateable with a female coupling element 218 carried on a discharge station 226. The shuttle 220 is movable between the filling station 212 and discharge station 226 by operation of a cylinder 228 having a piston 230. In response to the extension of piston 230, the shuttle is movable upwardly along guide rods 222, 224 to a filling position wherein the male coupling element 216 at the filling station 212 mates with the female coupling element 218 on the shuttle 220. When the cylinder piston 230 is retracted, the shuttle 220 is moved to a discharge position wherein the male coupling element 216 carried on the lower surface of shuttle 220 mates with the female coupling 218 at the discharge station 226.

The shuttle 220 is connected by a line 232 to the reservoir 234 of a large capacity, piston pump 236, preferably of the type disclosed in U.S. Pat. No. 5,221,194, owned by the assignee of this invention. The piston pump 236 includes an internal piston head (not shown) connected to an outwardly extending piston rod 240. The piston pump 236 is pneumatically operated, such that upon pressurization of that portion of the piston reservoir 234 above the piston head, the piston rod 240 and piston head move downwardly into the reservoir 234 to discharge coating material from the piston pump 236. Such downward movement of the piston rod 240 is monitored, in a manner described below, to assist in the change-over of the supply of coating material from one of the supply units 202, 202' to the other.

The piston pump 236 is connected by a line 242 to the male coupling element 216 carried at the base of shuttle 220. With the shuttle 220 in a discharge position, as noted above, a flow path is created from the piston pump 236, through line 242 and then through the mating male and female coupling elements 216, 218 carried by the shuttle 220 and discharge station 226, respectively. The coating material is allowed to pass through the female coupling element 218 at the discharge station 226 into a common discharge line 244 which is connected at its opposite end to the female coupling element 218' at the discharge station 226' of second paint supply unit 202'. This common discharge line 244, in turn, is connected by an outlet line 246 to one or more coating dispensers 204, noted above. In the presently preferred embodiment, the outlet line 246 is connected to a dump line 248 leading to a dump container or hopper (now shown). It is understood that such dump line 248 must be isolated from earth ground. Preferably, a manually or pneumatically operated valve 252 is carried in the dump line 248 to control the passage of coating material or flushing materials therethrough, as described more fully below.

Having described the paint delivery elements of apparatus 200, for purposes of discussion, the first paint supply unit 202 is considered to include all elements within the area defined by paint lines 232 and 242, including the voltage block device 214. Similarly, the second paint supply unit 202' is considered to include all elements within the area defined by paint lines 232' and 242', including voltage block device 214'.

Pneumatic/Mechanical Control System

Figure 8:
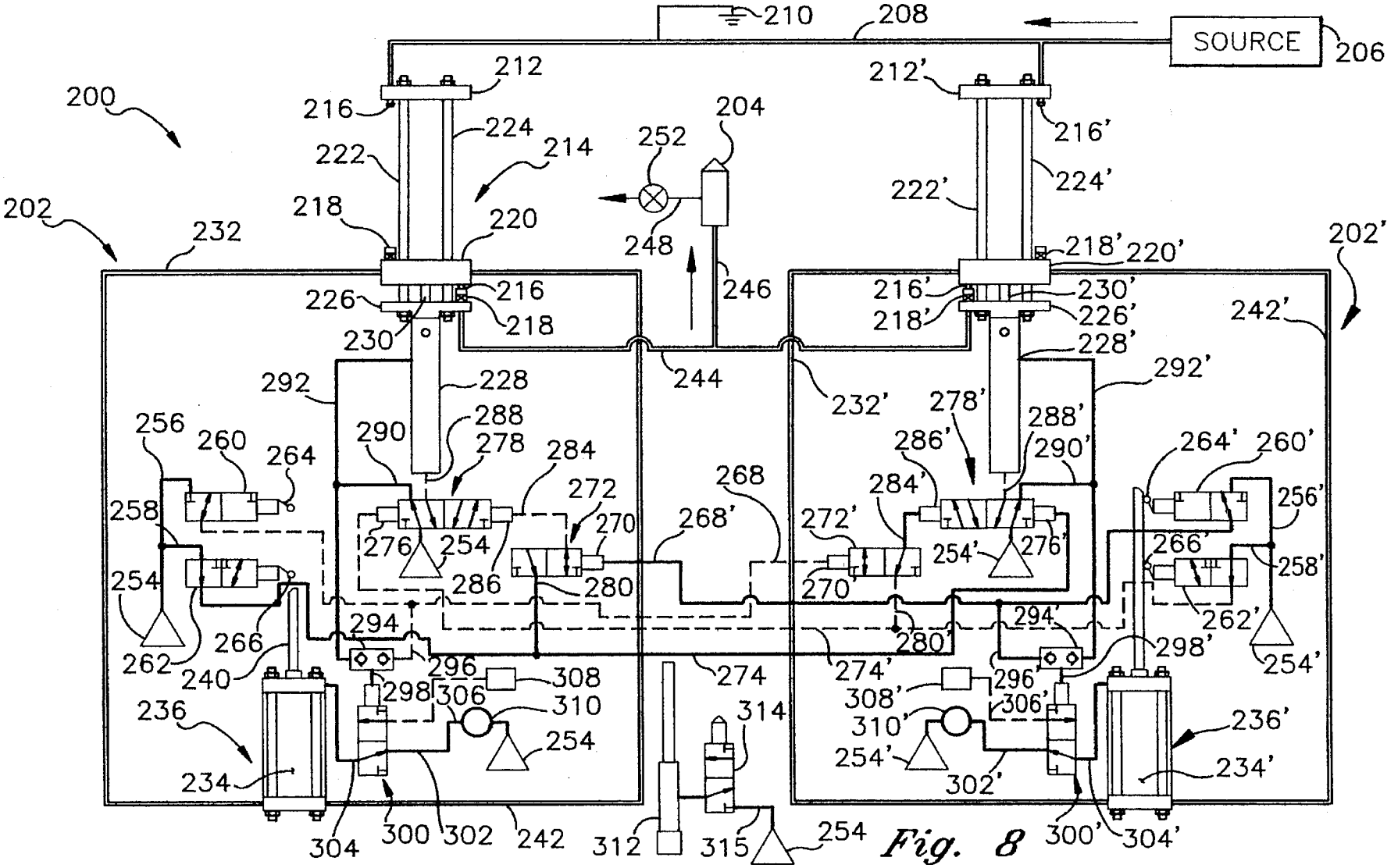
FIG. 8 is a view similar to FIG. 7, except with both parallel flow paths supplying coating material to one or more coating dispensers.
Figure 9:
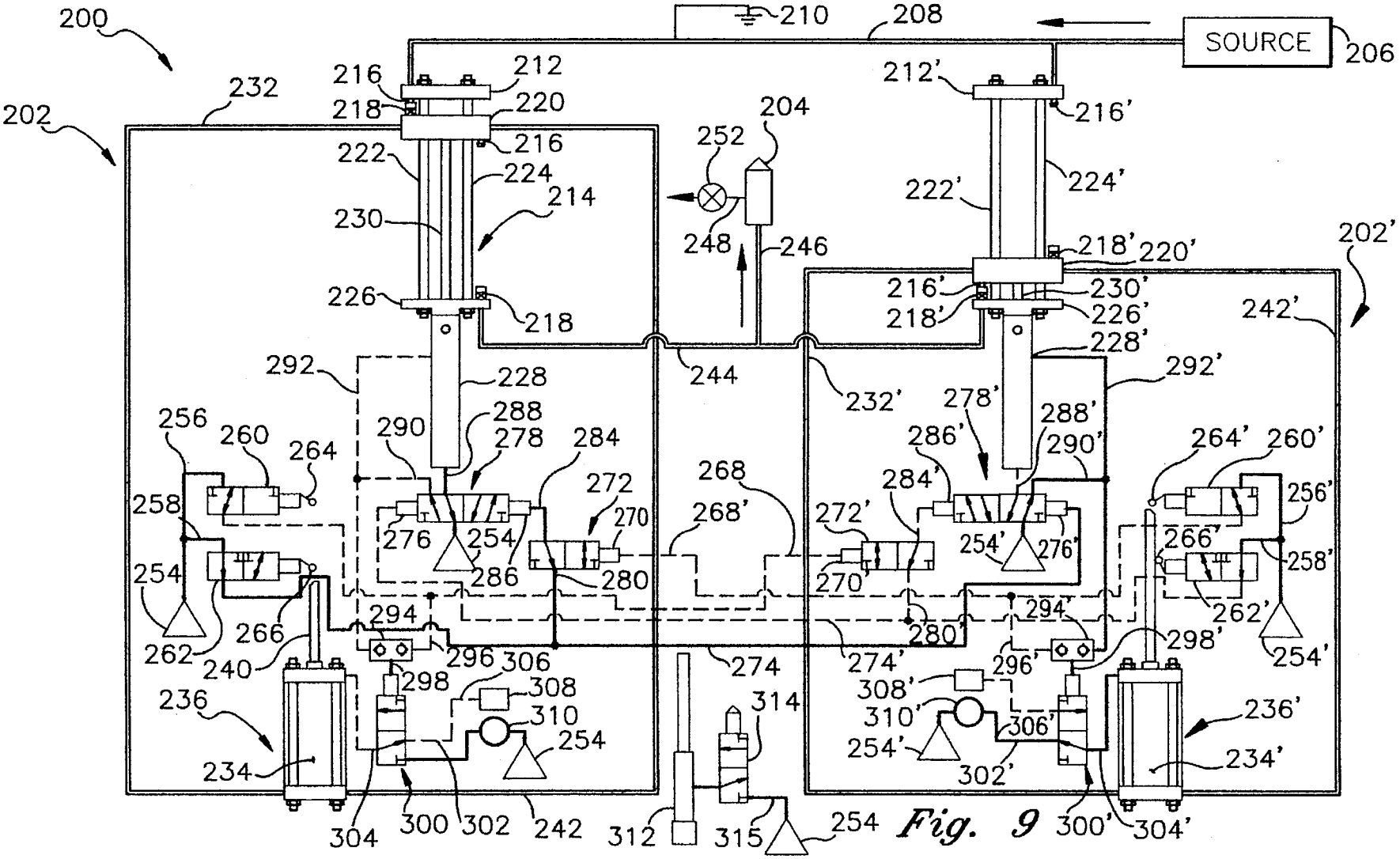
FIG. 9 is a view of the system depicted in FIG. 7 during a color change operation.
Figure 10:
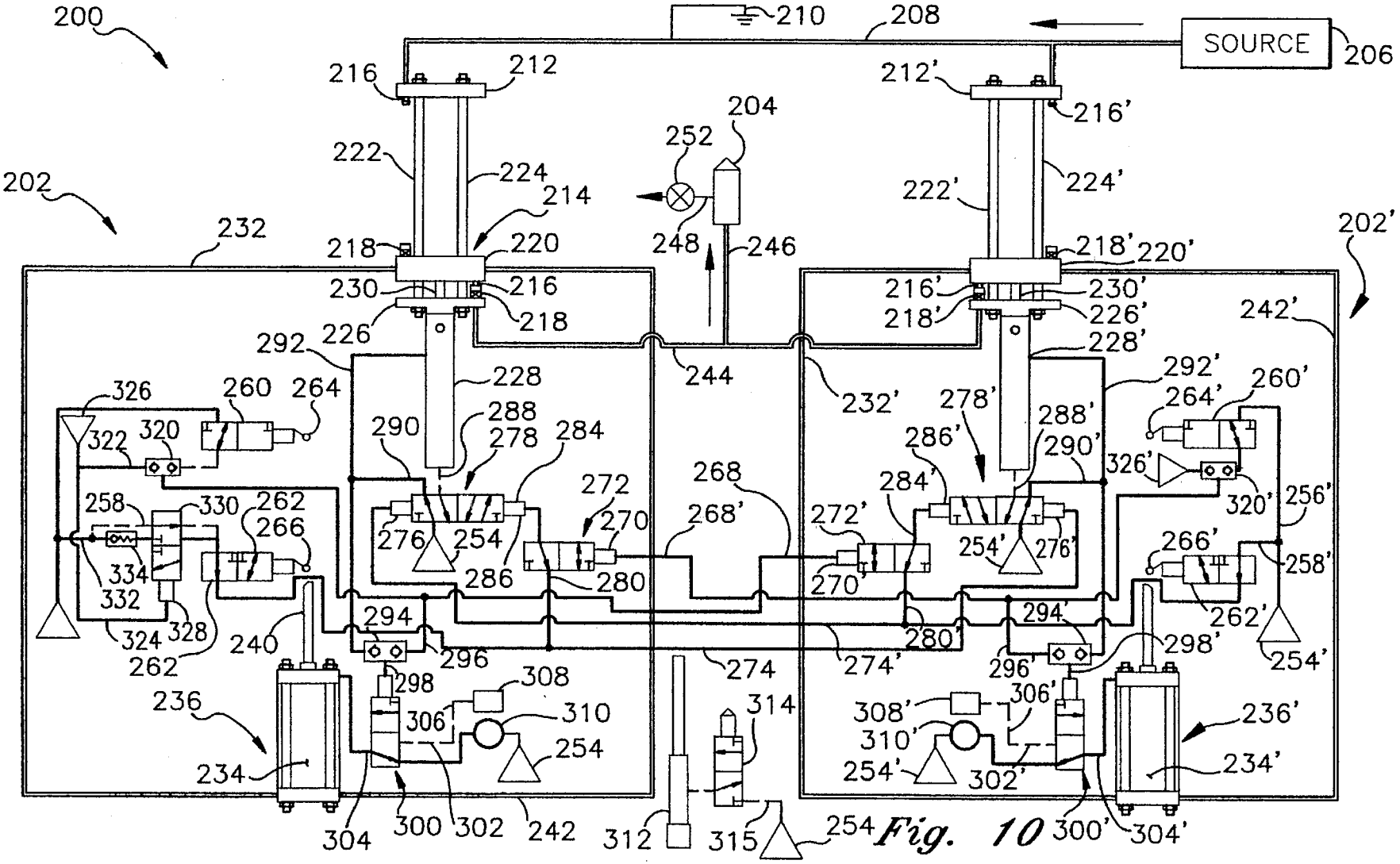
FIG. 10 is a view similar to FIG. 9 wherein the system is reset after a color change/dump operation.

With reference initially to FIGS. 7–9, the pneumatic/mechanical system for operating apparatus 200 under normal spraying condition is illustrated. Additional control structure is added as depicted in FIG. 10 to perform a color change operation described in more detail below. As was the case in describing the paint delivery construction of apparatus 200 above, the pneumatic/mechanical control system of this invention is the same for the first paint supply unit 202 and second paint supply unit 202'. For purposes of the present discussion, therefore, the same reference numbers used to describe the construction of first paint supply unit 202 are employed to identify like structure in the second paint supply unit 202', with the addition of a "'" to such numbers. Additionally, for ease of reference and as described in detail below in connection with a discussion of the operation of apparatus 200, the various air lines associated with the pneumatic/mechanical control of this invention are shown in dotted lines when no air is passing therethrough and in solid, bold lines when receiving a flow of air.

As shown on the left-hand portion of FIG. 7, air from a source 254 is transmitted through a common line 256 and branch line 258 to an upper limit valve 260 and lower limit valve 262, respectively. This "air source" 254 is schematically shown as a triangular block in the Figs. and represents an air supply from normal shop air or the like. Several triangular boxes are noted in the Figs. to depict location within the apparatus 200 where pressurized air is directly supplied from outside the apparatus, and each such box is identified with the reference number 254. The upper limit valve 260 is preferably of the type commercially available from Clippard Laboratory, Inc. of Cincinnati, Ohio under Model No. MJV-3, and the lower limit valve is preferably a Model MJVO-3 available from the same company. The upper and lower limit valves 260, 262 are turned on and off by operation of trip bars 264, 266, respectively, which are positioned in the path of the piston rod 240 from the piston pump 236. As described below, depending upon the position of the piston rod 240, the upper and lower limit valves 260, 262 are effective to control the flow of pressurized air therethrough to other elements of the pneumatic/mechanical control system.

The outlet of upper limit valve 260 is connected by a line 268 to the pilot 270' of an operating valve 272' associated with the second paint supply unit 202'. Similarly, the upper limit valve 260' is connected by a line 268' to the pilot 270 of operating valve 272 located within the first paint supply unit 202. The lower limit valve 262 is connected by a line 274 to one pilot 276' of a shift valve 278' associated with the second paint supply unit 202'. A branch line 280 extends from the line 274 to the operating valve 272 contained within the first paint supply unit 202. Preferably, the shift valve 278 is of the type commercially available from Clippard Laboratory, Inc. under Model No. MJV-4D. Similar structure is provided to connect the lower limit valve 262' of the second paint supply unit 202' to the first paint supply unit 202, i.e., a line 274' extends from the lower limit valve 262' to the pilot 276 of shift valve 278. The line 274' is connected by a branch line 280' to the operating valve 272' within second paint supply unit 202.

As depicted at the center of FIG. 7, the operating valve 272 within first paint supply 202 is connected by a line 284 to the opposite pilot 286 of shift valve 278. The identical structure is provided within second paint supply unit 202'. In turn, the shift valve 278 is connected by a line 288 to the base of cylinder 228 associated with the voltage block device 214. Pressurization of line 288 causes the piston 230 of cylinder 228 to extend, thus moving the transfer shuttle 220 to the filling station 212 for purposes described below. The shift valve 278 is also connected to a branch line 290, which, in turn, connects to a transfer line 292. One end of transfer line 292 connects to upper portion of cylinder 228, and its opposite end terminates at a air shuttle valve 294. This air shuttle valve 294 is connected by a line 296 to the line 268 from upper limit valve 260, and by a pilot line 298 to the pilot of an operating valve 300. The identical structure described above is provided within the second paint supply unit 202' and identified with corresponding reference numbers.

In the presently preferred embodiment, the operating valve 300 is associated with the piston pump 236. Pressurized air is directed from source 254 through a line 302 to the operating valve 300, which, in turn, is connected by a supply line 304 to the reservoir 234 of piston pump 236. Depending upon whether or not the operating valve 300 is piloted, pressurized air is either transferred from line 302 through the operating valve 300 and into supply line 304 to the piston pump 236, or, alternatively, pressurized air is exhausted in the opposite direction through supply line 304 and operating valve 300 into an exhaust line 306 connected to a filter 308. As schematically depicted in the Figs., the line 302 may be connected to a source of lubricant 310 which can be transmitted through operating valve 300 and supply line 304 into the interior of the reservoir 234 of piston pump 236 to periodically lubricate the piston head and piston rod 240 associated with piston pump 236.

Additionally, the apparatus 200 depicted in FIGS. 7–10 includes a grounding device 312 which is activated by a door valve 314 connected by a line 315 to the air source 254. In response to opening of the door of the cabinet (not shown) which houses the apparatus 200, pressurized air is allowed to pass through the door valve 314 to the grounding device 312 which grounds out the electrostatics of the apparatus 200 to avoid any hazard of electrical shock.

OPERATION OF APPARATUS 200

The operation of apparatus 200 is discussed herein first with reference to the supply of coating material to one or more coating dispensers 204 under normal spraying conditions. A color change and flushing/cleaning operation is then described with particular reference to FIG. 10, including a description of additional control structure which is particularly intended to perform such color change and flushing operations.

Supply of Coating Dispensers

The operation of apparatus 200 is predicated upon the concept of supplying a high volume, continuous flow of coating material to the coating dispenser(s) 204 with substantially no fluctuation in supply pressure while spraying with the same color of coating material. As an overview, this is accomplished in the apparatus 200 herein by providing a transition period during which time coating material is supplied into the discharge line 244 and outlet line 246 leading to the coating dispenser 204 from both of the piston pumps 236 and 236', one of which being nearly empty and the other of which is full. Only when the full piston pump 236 or 236' comes "on-line" does the pneumatic/mechanical control system herein allow the empty piston pump 236 or 236' to stop pumping and receive new coating material from the source 206.

For purposes of the present discussion, a sequence of operation is depicted in FIGS. 7–9 wherein coating material is supplied to one or more of dispensers 204 from piston pumps 236 and 236' for deposition onto a particular substrate. As noted above, in order to better illustrate the operation of the pneumatic/mechanical control system, the various air lines within first and second paint supply units 202 and 202' are shown as solid lines when pressurized air is flowing therethrough, and as dotted lines when there is no flow of air. The lines transmitting coating material are uniformly depicted with double lines.

Referring initially to FIG. 7, it is assumed for purposes of discussion and illustration that coating material is being supplied from the piston pump 236 of first paint supply unit 202 through the flow path defined by line 242, the discharge station 226 of voltage block device 214, discharge line 244 and outlet line 246 leading to dispenser 204. The piston pump 236' within second paint supply unit 202' is shown as being completely filled with coating material such that its piston rod 240 is fully extended and positioned to "trip" or engage the trip bars 264' and 266' associated with upper and lower limit valves 260', 262', respectively. Additionally, the piston rod 240 of piston pump 236 is shown in a "middle" position, i.e., between the upper and lower limit valves 260 and 262, such that the trip bar 264 of upper limit valve 260 has been released while the trip bar 266 of lower limit valve 262 remains in a tripped position.

With the upper and lower limit valves 260, 262 of first paint supply unit 202 in a position described above, and the upper and lower limit valves 260', 262' of second paint supply unit 202' in the position depicted in FIG. 7, pressurized air flows through the pneumatic/mechanical control system as shown in solid lines in FIG. 7. Specifically, pressurized air from source 254 passes through the shift valve 278 within first paint supply unit 202 into branch line 290, and then to transfer line 292 having one end connected to the top of cylinder 228 and the opposite end connected to air shuttle valve 294. Pressurization of the top of cylinder 228 forces its piston 230 downwardly, thus moving the male coupling element 216 carried by shuttle 220 into coupling engagement with the female coupling element 218 at the discharge station 226. The air shuttle valve 294 causes pilot valve 200 to permit the flow of pressurized air from line 304 therethrough to line 304. This pressurizes the top of piston pump 236 driving its piston head downwardly so that coating material can be transferred into line 242 to the discharge station 226 as mentioned above. It is also noted that pressurized air is supplied to each of the upper and lower limit valves 260, 262 within first paint supply unit 202, but each of these valves are closed in view of the position of piston rod 240 of piston pump 236.

With reference to the right-hand portion of FIG. 7, and second paint supply unit 202', it is noted that the shift valve 278' permits the passage of pressurized air therethrough to the base of cylinder 228'. This causes the cylinder piston 230' to drive shuttle 220' upwardly to the filling station 212' where the female coupling element 218' carried by the shuttle 220' engages the male coupling element 216' at the filling station 212. A completed flow path is thus provided from the paint source 206, through the filling station 212' and the 232' to the piston pump 236'. As depicted in solid lines within second paint supply unit 202', with the piston rod 240' of piston pump 236' in position to actuate the trip bar 264' of upper limit valve 260', a flow of air is permitted through upper limit valve 260' into line 268' to the pilot 270 of operating valve 272 within first paint supply unit 202. When piloted, the operating valve 272 vents pilot 286 of operating valve 278 through line 284 to atmosphere. Additionally, operating valve 272, when piloted, blocks any pressure that develops in line 280. No pressurized air is present at the operating valve 272 at this point in the system operation because the trip bar 266 of lower limit valve 262 has not been released by piston rod 240 thus blocking the flow of air through air lines 274 and 280.

Referring now to FIG. 8, the piston pump 236 within first paint supply unit 202 is illustrated as having been emptied to the point where its piston rod 240 has released the trip bar 266 of lower limit valve 262. Note that the piston rod 240' of piston pump 236 remains in its fully extended position and continues to activate trip bars 264', 266' of limit valves 260', 262'. The release of trip bar 266 allows pressurized air to pass through lower limit valve 262 and into the line 274 leading to the pilot 276' of switch valve 278'. When piloted, the switch valve 278' shifts to a position allowing the passage of pressurized air into the branch line 290' connected to line 292'. Operating air within line 292' pressurizes the top of cylinder 228', thus moving the shuttle 220' to the discharge station 226' and in position to transfer coating material from the full piston pump 236' through line 232' and then into line 244. At the same time, line 292' sends operating air through air shuttle valve 294' to the top of piston pump 236', thus forcing its piston head downwardly to discharge coating material within its reservoir 234' into line 242'.

It is noted in FIG. 8, that the operating air allowed to flow through lower limit valve 262 and into line 274 is transferred via line 280 to the operating valve 272. But, because the operating valve 272 remains piloted by air supplied through upper limit valve 260' and line 268' to pilot 270, no air can pass through the operating valve 272 at this time. Consequently, both the piston pump 236 and piston pump 236' supply coating material into the discharge line 244 and outlet line 246 leading to dispenser 204.

The operating condition shown in FIG. 8 is temporary and intended to ensure that the full piston pump 236' is brought "on-line" at the same time the nearly empty piston pump 236 is supplying coating dispenser 204. This ensures that a transition in the supply of coating material from the empty piston pump 236 to the full piston pump 236' occurs with substantially no fluctuation in the pressure of the coating material at the coating dispenser(s) 204.

The simultaneous supply of coating material from piston pumps 236 and 236' continues until the piston rod 240' of piston pump 236' releases the trip bar 264' associated with upper limit valve 260'. As shown in FIG. 9, this stops the flow of pressurized air through upper limit valve 260' and permits the operating air within line 268' to be exhausted. As a result, the pilot 270 of operating valve 272 is released and pressurized air from line 280 is allowed to pass through operating valve 272 to the pilot 286 of shift valve 278. When piloted, the shift valve 278 moves to the position depicted in FIG. 9 wherein operating air from source 254 is supplied to the base of cylinder 228. With the base of cylinder 228 pressurized, its piston 230 is driven upwardly, thus carrying shuttle 220 to the filling station 212 where the female coupling element 218 mounted to shuttle 220 mates with the male coupling element 218 at the filling station 212. This couples the line 232 connected to piston pump 236 to the supply line 208 from paint source 206 allowing the piston pump 236 to be filled with coating material while the piston pump 236' supplies coating material to the dispenser 204.

The above-described operating procedure is reversed when the piston pump 236' becomes emptied and the piston pump 236 is filled. Supply of coating material from such pumps 236, 236' changes from one to the other during normal operating conditions with the provision that both pumps 236, 236' supply coating material simultaneously to the dispenser(s) 204 during a short transition period when the newly filled pump 236 or 236' is initially brought "on-line."

Color Change Operation

Referring now to FIG. 10, additional control structure is depicted which is particularly intended to accomplish a color change operation. This structure was omitted from FIGS. 7–9 for ease of illustration. In the presently preferred embodiment, a air shuttle valve 320 is mounted within line 268 in position between the upper limit valve 260 and the pilot 270' of operating valve 272'. The air shuttle valve 320, in turn, is connected by a transfer line 322 to an air signal line 324 which extends between an air signal source 326 and the pilot 328 of an operating valve 330. Preferably, operating valve 330 is of the type available from Clippard Laboratories of Cincinnati, Ohio under Model No. FV-3P. The operating valve 330 is mounted within the air line 258 in position between the lower limit valve 262 and a feed line 332 connected to the common line 256 carrying operating air from air source 254. In the presently preferred embodiment, a dilating check valve 334 is mounted within this feed line 332 between the common line 256 and operating valve 330. Additional control structure is provided within second paint supply unit 202', shown on the right hand portion of FIG. 10. Such structure, includes an air signal source 326' and a air shuttle valve 320', of the same type described above in connection with first paint supply unit 202.

Employing the above-identified control structure, a color change operation proceeds as follows. Initially, in order to conserve coating material, it is recommended that the operator note the flow rate at which coating material is being discharged from the dispenser(s) 204 and divide that rate into 120 oz., which is the minimum amount of coating material the apparatus 200 contains at any given time. It should be understood that this 120 oz. volume figure is a function of the size of piston pumps 236, 236' and other system elements, and could be altered depending upon whether or not other types of pumps or elements are utilized. The quotient of the flow rate and system coating material capacity provides an indication of the number of minutes before the apparatus 200 is nearly emptied of paint so that a color change operation can proceed with a minimum amount of waste. Once the last few minutes of coating time has expired, the air signal sources 326, 326' are activated to deliver air signals through lines 322, 322' and air shuttle valves 320, 320'. As depicted in FIG. 10, the air signal from air signal source 326 is directed by line 268 to the pilot 270' of operating valve 272'. Similarly, the air signal from air signal source 326' is directed through line 268' to the pilot 270 of operating valve 272. Actuation of the operating valves 272, 272' causes them to move to a closed position, so that air cannot pass therethrough, and also allows any air at the pilots 286, 286' of shift valves 278, 278', respectively, to be exhausted through operating valves 272 and 272'.

At the same time that operating air signals are transmitted to operating valves 272 and 272', operating air is also directed to the reservoirs 234 and 234' of piston pumps 236 and 236'. This is because the operating valves 300, 300' are piloted by air flow through lines 268, 268', into lines 296, 296', and then air shuttle valves 294, 294', respectively. When pressurized in this manner, the pump 236 or 236' that is being filled with coating material stops filling because the area within reservoir 234 above the pump piston is pressurized and does not allow further coating material to enter the reservoir 234. The pump 236 or 236' which was in the process of emptying, as described above, stops at the lower limit valve 262 or 262' and does not refill. Once the pump 236 or 236' which was in the process of emptying before initiation of the color change operation is completely emptied, the other pump 236 or 236' which was in the process of being filled also empties, so that both pumps 236 and 236' are completely emptied with their piston rods 240 and 240' in the down position depicted in FIG. 10. If desired, at or near the end of a production run, the coating dispenser 204 may be turned off and the valve 252 within dump line 248 opened, so that the last portion of the coating material within pumps 236, 236' is expelled through the dump line 248 rather than the coating dispenser(s) 204.

After both of the piston pumps 236 and 236' are emptied of coating material and their piston rods 240, 240' are in the down position depicted in FIG. 10, the air pressure signals provided from air signal sources 326, 326' are shut off and flushing water is introduced into the paint supply line 208 for purposes of cleaning the system. In the absence of a pressure signal from air signal sources 326, 326', the piston pumps 236 and 236' alternately fill to their respective lower limit valves 262 and 262' and then empty completely, cycling over and over. The apparatus 200 is operated in this fashion until the effluent at the dump line 248 is clear, thus indicating the system is ready to accept another color. At this time, the air signal sources 326 and 326' are again pressurized to force the pistons within both piston pumps 236, 236' to the fully down position, in the manner described above, so that both piston pumps 236, 236' are emptied of flushing water in preparation for the introduction of a new color.

At this point, therefore, remnants of the initial coating material have been removed with flushing water, and the introduction of air signals from air signal sources 326 and 326' has placed the piston rods 240, 240' of pumps 236, 236' into the position depicted in FIG. 10. In order to "reset" the apparatus 200 in preparation for spraying with another color of coating material, one of the piston pumps 236 or 236' must be allowed to receive coating material so that its piston rod 240 or 240' moves vertically upwardly, while the other piston pump 236 or 236' remains empty with its piston rod 240 or 240' in the down position. The reset sequence is initiated by discontinuing the air signal from sources 326, 326' so that the air within lines 268 and 268' is exhausted, thus releasing the pilots 270 and 270' of operating valves 272, 272'. With the pilot 270' of operating valve 272' released, a first air signal supplied by source 254' to line 274' is allowed to pass through the operating valve 272 and line 284' to the pilot 286' of shift valve 278'. As depicted in FIG. 10, the air line 274' is also connected to the pilot 276 of shift valve 278. Consequently, a first air signal from source 254' is present at the pilot 276 of shift valve 278 and at the pilot 276' of shift valve 278'.

Simultaneously with the release of pilots 270 and 270' of operating valves 272, 272', a second air signal is provided at the opposite pilots of shift valves 278 and 278', i.e., at the pilot 286 of shift valve 278 and at the pilot 286' of shift valve 278'. This second air signal is of slightly less pressure than the first air signal, e.g., on the order of about 10 psi less, due to the passage of operating air through the dilating check valve 334. With reference to the left hand portion of FIG. 10, the flow path through dilating check valve 334 is created when the air signal from air signal source 326 is discontinued, allowing the operating valve 330 to shift to a position which permits a flow of air from line 332 therethrough to the dilating check valve 334. In the course of passage through the dilating check valve 334, pressure of the second air signal is reduced approximately 10 psi, which, in turn, passes through the lower limit valve 262 into line 274 within first paint supply unit 202. Because the operating valve 272 has been opened by the release of its pilot 270, as noted above, the lesser pressure second air signal from line 274 is allowed to pass via line 280 through the operating valve 272 and line 284 to the pilot 286 of shift valve 278. The line 274 is also directly connected to the pilot 276' of shift valve 278', thus supplying the lower pressure second air signal from dilating check valve 334 thereto.

Ordinarily, piloting both sides of shift valves 278 and 278' would have no effect, i.e., they would be prevented from shifting position. But because the second air signals at pilots 276' and 286 have a lesser pressure than the first air signals at the pilots 276 and 286', the shift valves 278 and 278' are piloted at pilots 276 and 286' causing them to change position. Consequently, one of the cylinders 228 or 228' is pressurized to move its shuttle 220 or 220' to the filling station 212 of 212', while the other shuttle 220 or 220' is moved to the discharge station 226 or 226'. The apparatus 200 is ready to resume operation with the new color of coating material when one of the pistons 236 or 236' is completely filled with coating material and its piston rod 240 or 240' is in the fully raised position (see piston rod 240' in FIG. 7), while the other piston pump 236 or 236' is partially filled with coating material so that its piston rod 240 or 240' contacts the trip bar 266 or 266' of lower limit valve 262 or 262'. The coating operation can then proceed as described with reference to the discussion of FIGS. 7–9 above.

It should be understood that the presence of lesser pressure, second air signals at shift valve pilots 276' and 286 need be provided for only a few milliseconds to allow the higher pressure first air signals at shift valve pilots 276 and 286' to "win out" or force the shift valves 278, 278' to move. Once the shift valves 278, 278' have shifted position, the air signal from air signal source 326 can be discontinued thus allowing the air flow from common line 256 to flow through operating valve 330 and into lower limit valve 262 via line 258 bypassing the dilating check valve 334.

ALTERNATIVE PARALLEL COATING SUPPLY APPARATUS

Referring now to FIGS. 11–14, an alternative embodiment of an apparatus 350 according to this invention is shown. The apparatus 350 contains a simplified version of the pneumatic/mechanical control system of apparatus 200, wherein the operating valves 278, 278' and 300, 300' are eliminated. Instead of relying upon the operating valves 278, 278' to create a transition period during which time both pumps 236, 236' supply coating material to dispenser(s) 204, such transition period is obtained solely by operation of upper and lower limit valves, as described below.

In the presently preferred embodiment, the system elements for transmitting coating material are the same in apparatus 350 as in the apparatus 200 described above. Consequently, the same reference numbers are used in FIGS. 11–14 as in FIGS. 7–10 to denote the same structure. The operation of such common elements is not described separately in connection with a discussion of FIGS. 11–14. Additionally, the same shift valves 278, 278' described above are employed in the embodiment of apparatus 350, and the same reference numbers are therefore used in FIGS. 11–14 as in FIGS. 7–10.

Figure 11:
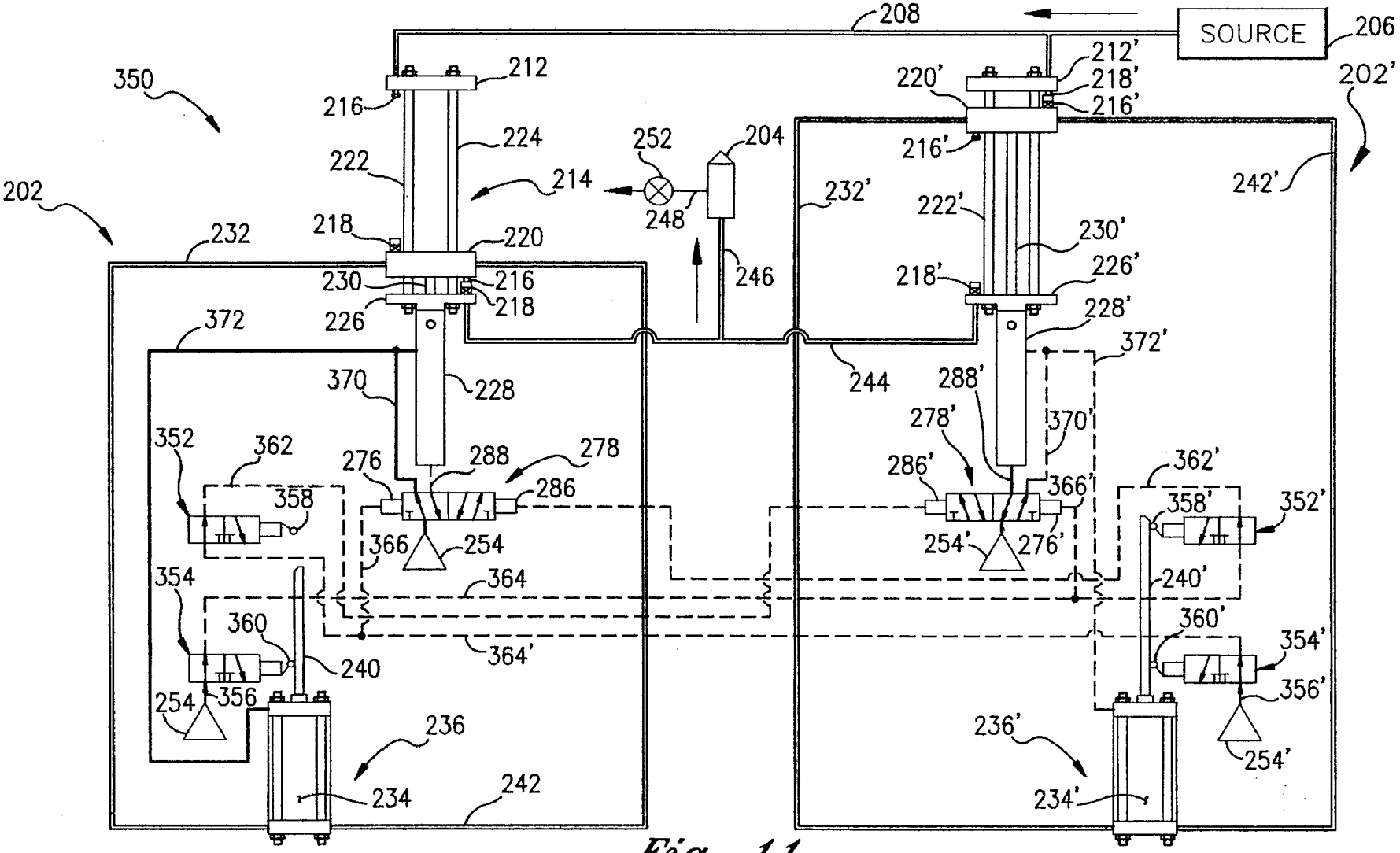
FIGS. 11–14 shown an alternative embodiment of the present invention having a simplified version of the pneumatic/mechanical control system.
Figure 12:
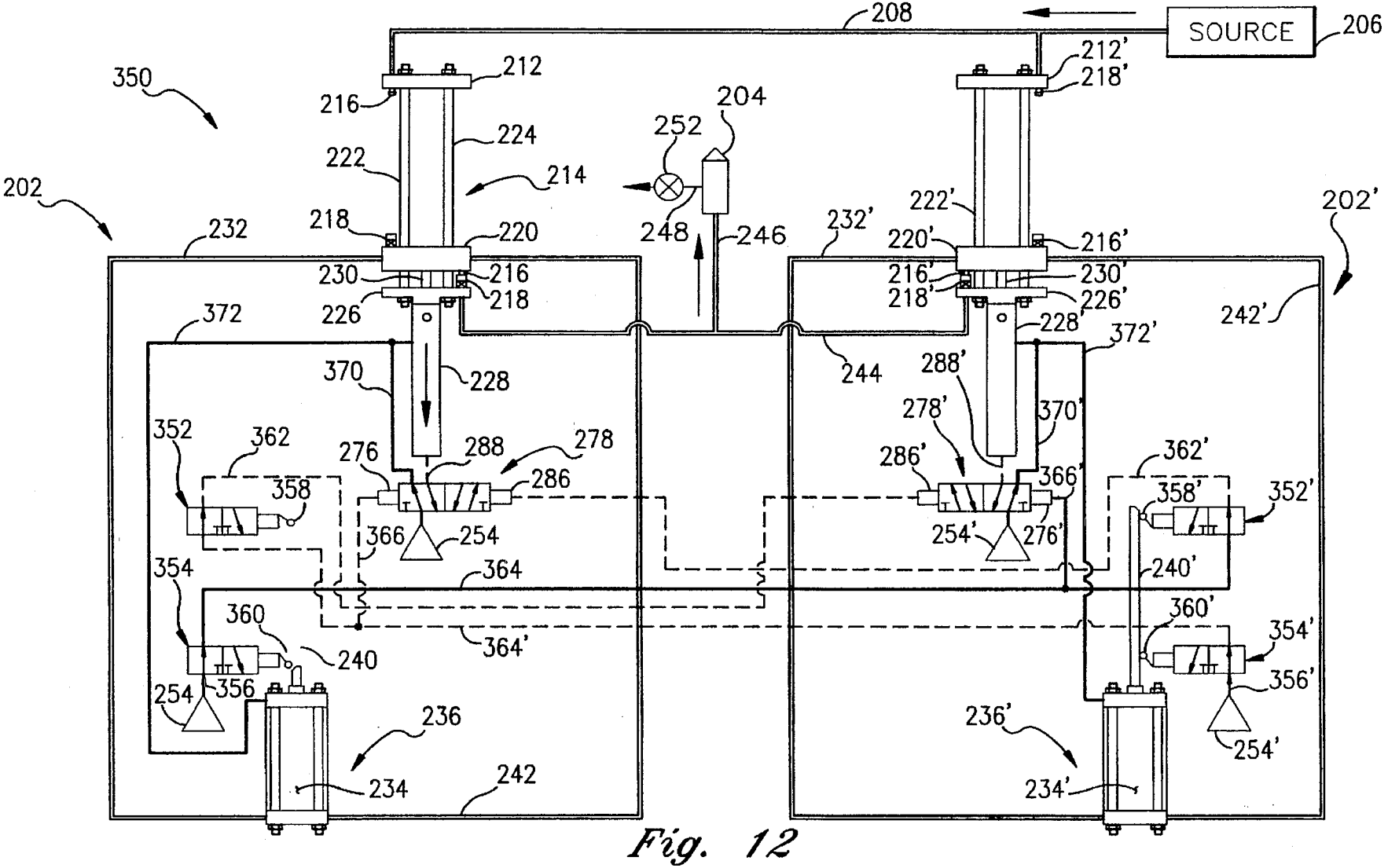

As noted above, the principal difference between the apparatus 350 of the embodiment of FIGS. 11–14 and the apparatus 200, is the operation of the pneumatic/mechanical control system. Referring to FIG. 11, the first paint supply unit 202 of apparatus 350 includes an upper limit valve 352 and a lower limit valve 354 connected by a line 356 to the source 254 pressured air. Unlike apparatus 200, the upper limit valve 352 of apparatus 350 is preferably of the type sold by Clippard Laboratory, Inc. of Cincinnati, Ohio under Model No. MJVO-3. The lower limit valve 354 is identical. The upper and lower limit valves 352, 354 each have trip bars 358, 360, respectively, which are engageable with the piston rod 240 of piston pump 236. Such valves 352, 354 function in the same manner as described above in connection with upper and lower limit valves 260 and 262, except as described below. Additionally, upper and lower limit valves 352' and 354 are provided within the second paint supply unit 202', which are identical in structure and operation to upper and lower limit valves 352, 354.

The upper limit valve 352 is connected by an air line 362 to the pilot 286' of shift valve 278' within second paint supply unit 202'. Upper limit valve 352 receives a supply of pressurized air, as described below, from a line 364' extending from the lower limit valve 354', which, in turn, is connected to the air source 254' via line 356'. The line 364' is connected by a branch line 366 to the pilot 276 of shift valve 278. The lower limit valve 354 within first paint supply unit 202 is connected to the upper limit valve 352' within second paint supply unit 202' in the same manner. Line 364 interconnects lower limit valve 354 with the upper limit valve 352'. Line 362', in turn, extends from upper limit valve 352' to the pilot 286 of shift valve 278. A branch line 366' extends from air line 362' to the pilot 276' of shift valve 278'. Shift valve 278 is connected by a line 370 to the top of the cylinder 228 associated with voltage block device 214, and such line 370 intersects a connector line 372 extending to the top of the reservoir 234 of piston pump 236. The same structure is provided within the second paint supply unit 202'.

The foregoing pneumatic/mechanical control structure operates the apparatus 350 during a normal cycle of supply of coating material to one or more dispensers 204. In order to undergo a color change operation, described below, the control system further includes a dilating check valve 368 which is mounted within line 356' between the air source 254 and the lower limit valve 354' within second paint supply unit 202'. See FIG. 13. Such color change operation is described after the following a discussion of the normal operation of apparatus 350.

Operation of Apparatus 350

Referring initially to FIG. 11, the apparatus 350 is shown in an operating condition wherein coating material is being supplied to the dispenser(s) 204 by piston pump 236. Shift valve 278 is in a position to permit the flow of pressurized air from source 254 into line 370 connected to the top of shuttle cylinder 228 which, as described below, places the shuttle 220 at the discharge station 226. Line 370 transmits pressurized air through connector line 372 to the top of the pump reservoir 234 so that coating material can be discharged from the piston pump 236 into line 242. The piston pump 236', on the other hand, is depicted in a completely filled condition wherein its piston pump 236' is fully extended and contacts the trip bars 358' and 360' of upper and lower limit valves 352' and 354', respectively.

An important aspect of the operation of apparatus 350 is to maintain substantially constant pressure of coating material transmitted to dispenser(s) 204 during changeover in the supply of coating material from one piston pump 236 to the other piston pump 236'. This is accomplished by the sequence of operations depicted in FIGS. 12 and 13. When the piston rod 240 of piston pump 236 releases the trip bar 360 of lower limit valve 354, the lower limit valve 354 shifts position to permit the flow of pressurized air therethrough and into line 364 as depicted in solid lines in FIG. 12. Because the piston rod 240' of piston pump 236' has not yet released the trip bar 358 of upper limit valve 352', the pressurized air cannot pass from line 364 through upper limit valve 352'. Nevertheless, the pilot 276' of shift valve 278' is pressurized by the flow of air from line 364 into branch line 366'. This causes shift valve 278' to change position so that air flows therethrough from source 254' into line 370' and line 372'. In turn, the voltage block cylinder 228' is pressurized to move shuttle 220' downwardly to the discharge station 226', while, at the same time, pressurized air is supplied through line 372' to the top of the piston pump 236'. A completed flow path is therefore provided from piston pump 236', to the discharge station 226 and into discharge line 244 through which coating material from the now pressurized piston pump 236' is allowed to flow. A transition period is therefore provided for by the apparatus 350 of this invention without the use of operating valves 272 and 272' as described in apparatus 200. Both of the piston pumps 236 and 236' supply coating material to the dispenser (s) 204 during the transition period depicted in FIG. 12 so that full pressure is maintained within lines 244 and 246.

Figure 13:
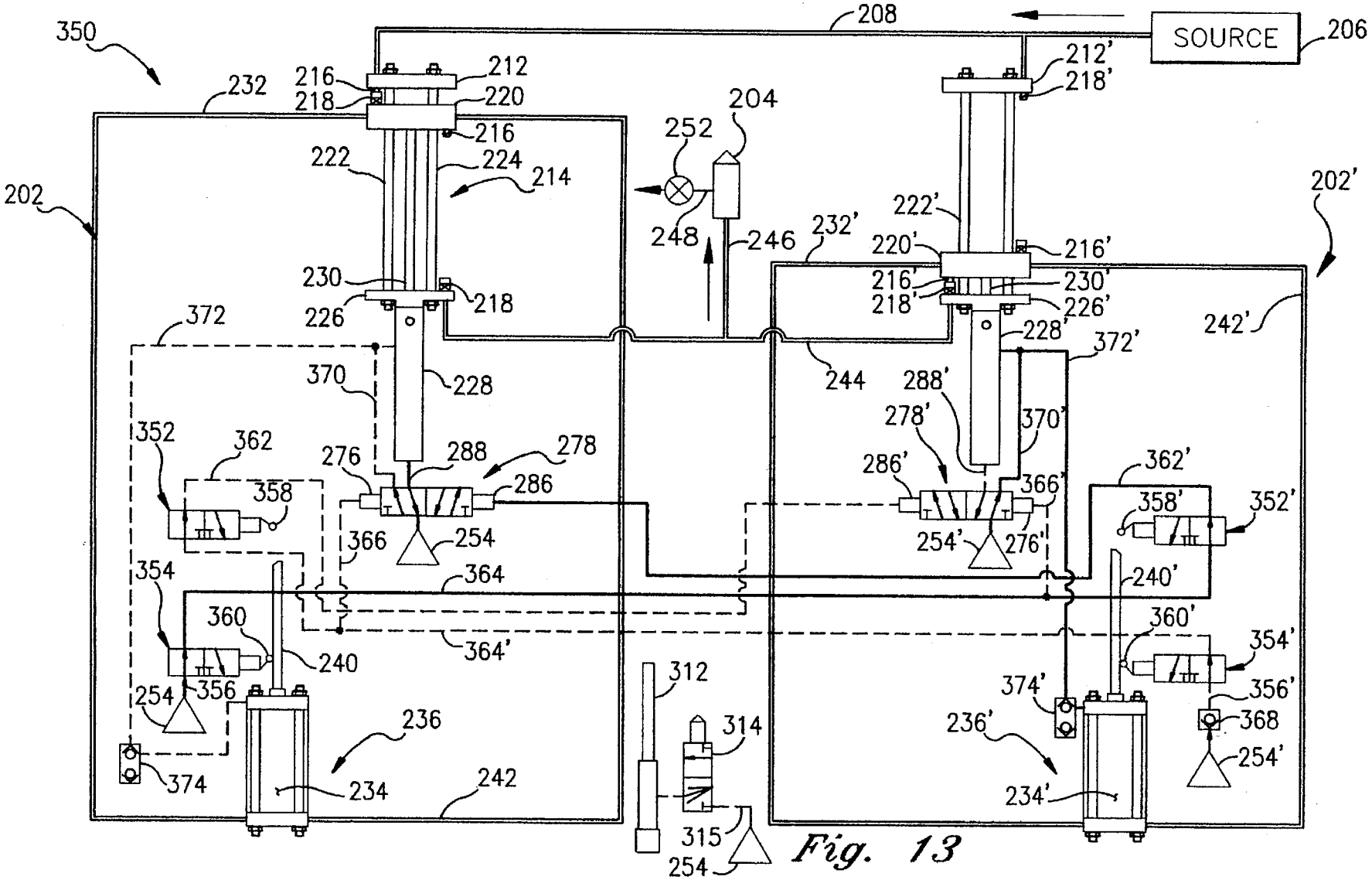

The supply of coating material from both piston pumps 236 and 236' continues until such time as the piston rod 240' of piston pump 236' releases the trip bar 358' of upper limit valve 352'. As shown in FIG. 13, release of trip bar 358' permits the flow of pressurized air through upper limit valve 352' which sends an air signal through line 362' to the pilot 286 of shift valve 278. In turn, shift valve 278 moves to a position wherein pressurized air passes therethrough to the bottom of the voltage block cylinder 228, thus driving the shuttle 220 upwardly to the filling station 212. Once positioned at the filling station 212, the shuttle 220 provides a completed flow path from source 206 through the filling station 212 and line 232 to the nearly empty piston pump 236. Meanwhile, the nearly full piston pump 236' continues to supply coating material to the dispensers 204 without interruption and without any fluctuation in pressure.

The above described cycle of operation continues throughout normal supply of coating material to the dispensers 204. The piston pumps 236 and 236' alternately supply coating material to the dispensers 204, except for the transition period wherein both pumps 236 and 236' supply coating material for a brief period of time to ensure that the pressure at the dispenser(s) 204 remains substantially constant and does not fluctuate.

Color Change Operation

The color change operation for the apparatus 350 depicted in FIGS. 11–14 is generally similar to that of apparatus 200.

In addition to the above-described pneumatic/mechanical control elements, a air shuttle valve 374 is mounted within the line 372 extending between the cylinder 228 of voltage block device 214 and the piston pump 236. The air shuttle valve 374, in turn, is connected by a line 376 to a color change air source 378 shown schematically in FIG. 14. This color change air source 378 can be a three-way valve, for example, connected to the same supply of pressurized air as sources 254 shown in the Figs. The same structure is provided within the second paint supply unit 202', as illustrated on the right-hand side of FIG. 14.

A color change operation proceeds as follows. Initially, a pressure signal from the color change air sources 378 and 378' is directed through the respective air shuttle valves 374 and 374' to the piston pumps 236 and 236'. At the same time, the flow of coating material into the apparatus 350 is shut off by deactivating the source 206. Regardless of where the apparatus 350 is in the operating cycle, pressurization at the top of the reservoirs 234, 234' of piston pumps 236, 236' causes them to discharge coating material to the dispenser(s) 204 in the manner described above. That is, the piston pump 236 or 236' which is in the process of supplying coating material to the dispenser(s) 204 continues to transmit such coating material, while the other piston pump 236 or 236' which is "off line" is prevented from receiving any additional coating material from source 206 because the top of its reservoir 234 or 234' is pressurized. The piston pumps 236 and 236' are completely emptied, and the coating material can either be discharged through the dispensers 204 or through a dump line (not shown) of the type described above in connection with a discussion of FIGS. 7–10.

After the piston pumps 236 and 236' are emptied, the air signals from color change air sources 378 and 378' are turned off and water is introduced to the apparatus 350 through the line 208 connected to source 206. The apparatus 350 cycles with the flushing water in the same manner as described above with the coating material so that all remnants of paint of one color are removed from the system by the flushing water. Such flushing can take place either through the dispenser(s) 204 or the dump line noted above. The flushing operation is continued until the operator visually determines that the effluent from the dispensers 204 or dump line is substantially clear. At that time, pressure signals from color change air sources 378 and 378' are initiated so that both piston pumps 236 and 236' are completely emptied in the same manner as described above. When emptied, the piston rods 240 and 240' of piston pumps 236 and 236' assume the position depicted in FIG. 14.

After the flushing operation is completed, the apparatus 350 must be "reset" prior to the initiation of a new coating operation with a different color. As described above in connection with the discussion of apparatus 200, the normal starting position of piston pumps 236 and 236' prior to the initiation of a coating operation is that one of the piston pumps 236 or 236' is completely filled with coating material and the other piston pump 236 or 236' is filled with coating material to a level wherein its piston rod 240 or 240' engages the trip bar 360 or 360' of the lower limit valve 354 or 354'.

Figure 14:
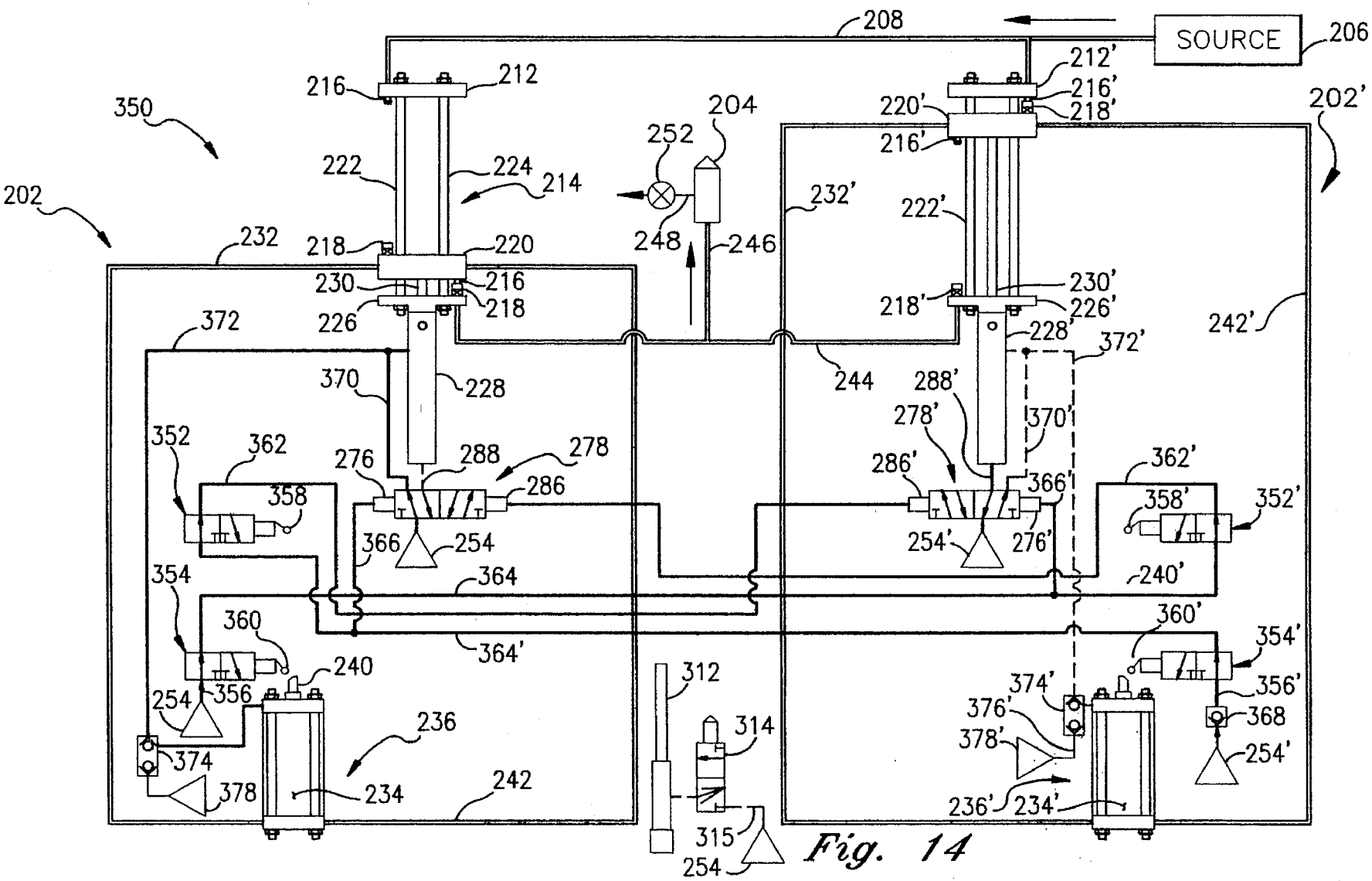

Referring to FIG. 14, the reset sequence proceeds as follows. With both piston rods 240 and 240' in the down position shown in FIG. 14, air signals are introduced through sources 254 and 254' which are transmitted to the pilots 276 and 286 of shift valve 278, and, simultaneously, to the pilots 276' and 286' of shift valve 278'. Under normal circumstances, the actuation of opposite pilots of shift valves 278 and 278' would result in a random shifting of such valves because the pilots would "fight" one another and it could not be predicted how such valves 278, 278' would shift. This situation is avoided by the apparatus 350 herein because the air pressure signal from source 254' within second paint supply unit 202' is directed through the dilating check valve 368' which reduces its pressure to a level of about 10 psi below that of the air signal supplied from air source 254 within first paint supply unit 202. As shown in FIG. 14, the lesser pressure air signal from source 254' and dilating check valve 368 passes through lower limit valve 354' into line 364'. The lower pressure signal then passes through upper limit valve 352 into line 362 where it is directed to the pilot 286' of shift valve 278'. Additionally, because branch line 366 is connected to line 364', a lesser pressure air signal is directed to the pilot 276 of shift valve 278. Simultaneously, higher pressure air signals are directed to the opposite pilots of shift valves 278 and 278', i.e., at the pilot 286 of shift valve 278 and the pilot 276' of shift valve 278'. This is because the higher pressure air signal from source 254 passes through the lower limit valve 354 into line 364 to branch line 366' which pilots the pilot 276'. Line 364 also carries the higher pressure air signal to the upper limit valve 352' which passes the higher pressure air therethrough to line 362' connected to the pilot 286 of shift valve 278. The higher pressure signal at shift valves 278 and 278' overcomes the lower pressure signals at the opposite pilots of such valves allowing one of the shift valves 278 to send an associated shuttle 220 or 220' to the filling station 212 or 212' while the other shuttle 220 or 220' moves to the discharge station 226 or 226'. The piston pumps 236 and 236' are filled with the new coating material, to the respective levels noted above, and a new coating operation can then begin.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. Apparatus for transmitting electrically conductive coating material to at least one electrostatic coating dispenser, comprising:

a first supply unit and a second supply unit, said first supply unit including a first transfer device having a reservoir and a voltage block connected to said reservoir, said second supply unit including a second transfer device having a reservoir and a voltage block connected to said reservoir;

a control device for controlling the operation of said first and second supply units, said control device including:

(i) a first sensor operative to produce a first signal when the coating material within said reservoir of said first transfer device is depleted to a selected level;

(ii) at least one first control element operative to initiate the flow of coating material from said reservoir of said second transfer device to the coating dispenser, in response to said first signal, while the flow of coating material from said first transfer device to the coating dispenser is continued;

(iii) a second sensor operative to produce a second signal after said second transfer device has supplied coating material to the coating dispenser;

(iv) at least one second control element operative to stop the flow of coating material from said first transfer device in response to said second signal.

2. The apparatus of claim 1 in which said voltage block of each of said first and second transfer devices comprises:

a shuttle movable between a fill position at which the reservoir of a respective first and second transfer device is placed in communication with a source of coating material, and a discharge position, spaced from said fill position, in which said reservoir transfers coating material to the electrostatic coating dispenser;

each of said shuttles being effective in said fill position to electrically isolate their associated reservoir from the electrostatic coating dispenser, and in said discharge position to electrically isolate said associated reservoir from the source.

3. The apparatus of claim 2 in which said first transfer device is a first piston pump having an outwardly extending piston rod, said first sensor comprising a trip bar associated with a limit valve, said trip bar being engageable with said piston rod, said trip bar allowing the flow of pressurized air through said limit valve when released by said piston rod which produces said first signal.

4. The apparatus of claim 3 in which said at least one first control element comprises a switch valve having a pilot which receives said first signal, said switch valve, when piloted, allowing the flow of pressurized air therethrough causing said shuttle of said second supply unit to move to said discharge position so that coating material can be transmitted from said second transfer device to the electrostatic coating dispenser.

5. The apparatus of claim 3 in which said at least one first control element comprises an operating valve having a pilot which receives said first signal, and a switch valve connected between said operating valve and said shuttle of said voltage block of said first supply unit, said operating valve being effective, when piloted, to pilot said switch valve which then allows the flow of pressurized air therethrough causing said shuttle of said second supply unit to move to said discharge position.

6. The apparatus of claim 5 in which said second transfer device is a second piston pump having an outwardly extending piston rod, said second sensor comprising a trip bar associated with a limit valve, said trip bar being engageable with said piston rod, said trip bar allowing the flow of pressurized air through said limit valve when released by said piston rod which produces said second signal.

7. The apparatus of claim 6 in which said at least one second control element comprises a switch valve having a pilot which receives said second signal, said switch valve, when piloted, allowing the flow of pressurized air therethrough causing said shuttle of said first supply unit to move to said fill position so that the flow of coating material to the electrostatic coating dispenser from said first piston pump is terminated and coating material can be transmitted into said reservoir of said first piston pump.

8. The apparatus of claim 7 in which said at least one control element comprises an operating valve having a pilot which receives said second signal, and a switch valve connected between said operating valve and said shuttle of said voltage block of said second supply unit, said operating valve being effective, when piloted, to pilot said switch valve which then allows the flow of pressurized air therethrough causing said shuttle of said first supply unit to move to said fill position.

9. Apparatus for transmitting electrically conductive coating material to at least one electrostatic coating dispenser, comprising:

a first supply unit and a second supply unit, said first supply unit including a first transfer device having a reservoir and a voltage block connected to said reservoir, said second supply unit including a second transfer device having a reservoir and a voltage block connected to said reservoir;

a control device for controlling the operation of said first and second supply units, said control device including:

(i) a first sensor operative to produce a first signal when the coating material within said reservoir of said first transfer device is depleted to a selected level;

(ii) at least one first control element operative to initiate the flow of coating material from said reservoir of said second transfer device to the coating dispenser, in response to said first signal, while the flow of coating material from said first transfer device to the coating dispenser is continued;

(iii) a second sensor operative to produce a second signal after said second transfer device has supplied coating material to the coating dispenser;

(iv) at least one second control element operative to stop the flow of coating material from said first transfer device in response to said second signal;

a color changer device, associated with each of said first and second supply units, which is operative to empty said first and second transfer devices of coating material, to allow the introduction of a cleaning fluid into said first and second transfer units, and then to introduce a coating material of a different color into said reservoir of each said first and second transfer devices in preparation for a new coating operation.

10. The apparatus of claim 9 in which said voltage block of each of said first and second transfer devices comprises:

a shuttle movable between a fill position at which the reservoir of a respective first and second transfer device is placed in communication with a source of coating material, and a discharge position, spaced from said fill position, in which said reservoir transfers coating material to the electrostatic coating dispenser;

each of said shuttles being effective in said fill position to electrically isolate their associated reservoir from the electrostatic coating dispenser, and in said discharge position to electrically isolate said associated reservoir from the source.

11. The apparatus of claim 10 in which said color changer device includes:

at least two valves, connected to a source of pressurized air, each of which are operative to pressurize the reservoir of one of said first and second transfer devices so that coating material therein is discharged and said reservoirs become substantially empty;

said at least two valves being operative, once said coating material is discharged, to permit said control device to introduce and circulate flushing fluid through said first and second supply units;

a pair of switch valves each connected to a shuttle of one of said first and second transfer devices, each of said switch valves having two pilots;

a pair of pilot signalling devices connected to said switch valves, one of said pilot signalling devices being operative to transmit a first pressure signal to one pilot of each of said switch valves, and the other of said pilot signalling devices being operative to transmit a second pressure signal to the other pilot of each of said switch valves, said first pressure signal having a greater pressure than said second pressure signal.

12. The apparatus of claim 11 in which said at least two valves are each one-way valves.

13. The apparatus of claim 11 in which said at least two valves are each an operating valve having a pilot connected to said source of pressurized air, said operating valves, when piloted, allowing the flow of pressurized air therethrough.

14. The apparatus of claim 11 in which said pair of pilot signalling devices comprises:

a limit valve connected to a source of pressurized air, and communicating through air lines to one pilot of each of said switch valves;

a dilating check valve connected to said source of pressurized air, and communicating through an air line to the other pilot of each of said switch valves, said dilating check valve being effective to reduce the pressure of the pressurized air supplied to said other pilot of each of said switch valves.

15. A method of transmitting electrically conductive coating material to at least one electrostatic coating dispenser, comprising:

transmitting coating material from a first supply unit to an electrostatic coating dispenser;

producing a first signal, by operation of a first sensor, when the quantity of coating material within the first supply unit is depleted to a selected level;

initiating the flow of coating material from a second supply unit to the electrostatic coating dispenser, in response to the first signal, while continuing the flow of coating material to the electrostatic coating dispenser from the first supply unit;

producing a second signal, by operation of a second sensor, after the second supply unit has been supplying coating material to the dispenser;

stopping the flow of coating material from the first supply unit in response to the second signal.

16. The method of claim 15 in which said step of producing a first signal comprises releasing a trip bar associated with a limit valve, said trip bar being released by the movement of the piston rod of a piston pump therepast.

17. The method of claim 15 in which said step of transmitting coating material from a first supply unit comprises pumping coating material from the reservoir of a piston pump to the electrostatic coating dispenser while maintaining the piston pump electrically isolated from the source of coating material.

18. The method of claim 15 in which said step of initiating the flow of coating material from a second supply unit comprises pumping coating material from the reservoir of a piston pump to the electrostatic coating dispenser while maintaining the piston pump electrically isolated from the source of coating material.

19. The method of claim 15 in which said step of producing a second signal comprises releasing a trip bar associated with a limit valve, said trip bar being released by the movement of the piston rod of a piston pump therepast.

20. A method of transmitting electrically conductive coating material to at least one electrostatic coating dispenser, comprising:

transmitting coating material from the reservoir of a first piston pump having a piston rod to an electrostatic coating dispenser;

sensing the position of the piston rod of the first piston pump by operation of a first sensor of the first piston pump as the reservoir of the first piston pump empties, and transmitting a first signal from the first sensor when the quantity of coating material within said reservoir is depleted to a selected level;

initiating the flow of coating material to the electrostatic coating dispenser from the reservoir of a second piston pump having a piston rod, in response to said first signal, while continuing the flow of coating material from the first piston pump;

sensing the position of the piston rod of the second piston pump by operation of a second sensor as the reservoir of the second piston pump empties, and transmitting a second signal from the second sensor after the second piston pump has been supplying coating material to the coating dispenser;

stopping the flow of coating material from the first piston pump in response to the second signal.

21. The method of claim 20 further including the steps of:

supplying coating material from a source to the reservoir of the first piston pump while electrically isolating the first piston pump from the electrostatic coating dispenser;

electrically isolating the source from the first piston pump while the first piston pump transmits coating material to the electrostatic coating dispenser.

22. The method of claim 20 further including the steps of:

supplying coating material from a source to the reservoir of the second piston pump while electrically isolating the second piston pump from the electrostatic coating dispenser;

electrically isolating the source from the second piston pump while the second piston pump transmits coating material to the electrostatic coating dispenser.

* * * * *